US010433695B2

(12) United States Patent
Hyun et al.

(10) Patent No.: US 10,433,695 B2
(45) Date of Patent: Oct. 8, 2019

(54) ROBOT CLEANER

(71) Applicant: SAMSUNG ELECTRONICS CO., LTD., Suwon-si, Gyeonggi-do (KR)

(72) Inventors: Du Hwan Hyun, Suwon-si (KR); Hwi Chan Jang, Suwon-si (KR); Dong Won Kim, Hwaseong-si (KR); Byoung In Lee, Suwon-si (KR); Sahng Jin Lee, Seongnam-si (KR); Won Min Lee, Busan (KR); Hyun Soo Jung, Seongnam-si (KR); Seung Il Han, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 75 days.

(21) Appl. No.: 15/711,428

(22) Filed: Sep. 21, 2017

(65) Prior Publication Data

US 2018/0028035 A1 Feb. 1, 2018

Related U.S. Application Data

(62) Division of application No. 14/075,431, filed on Nov. 8, 2013, now Pat. No. 9,795,265.

(30) Foreign Application Priority Data

Nov. 9, 2012 (KR) ..... 10-2012-0126898
Jun. 13, 2013 (KR) ..... 10-2013-0067636

(51) Int. Cl.
*A47L 11/40* (2006.01)
*A47L 11/14* (2006.01)
(Continued)

(52) U.S. Cl.
CPC ..... *A47L 11/4036* (2013.01); *A47L 11/145* (2013.01); *A47L 11/185* (2013.01);
(Continued)

(58) Field of Classification Search
CPC ..... A47L 11/4036; A47L 11/4044; A47L 11/4052; A47L 11/4083
See application file for complete search history.

(56) References Cited

U.S. PATENT DOCUMENTS 7,320,149 B1 1/2008 Huffman et al.
2006/0288519 A1 12/2006 Jaworski et al.
(Continued)

FOREIGN PATENT DOCUMENTS

KR 20-2012-0007096 10/2012
WO 2006/089307 8/2006
(Continued)

OTHER PUBLICATIONS

European Search Report dated Jan. 22, 2014 in corresponding European Patent Application No. 13 191 446.7.
(Continued)

*Primary Examiner* — Randall E Chin
(74) *Attorney, Agent, or Firm* — Staas & Halsey LLP

(57) ABSTRACT

A robot cleaner enables a wet cleaning, has a replaceable cleaning unit, and ensures a sufficient friction force for doing a wet cleaning of a floor. The robot cleaner includes a frame including a wheel for driving, a replaceable cleaning unit formed at a lower part of the frame to clean a bottom surface and disposed in front of the wheel, a tank disposed at an upper part of the wheel and configured to supply fluid to the cleaning unit, a pump configured to pump the fluid contained in the tank such that the fluid contained in the tank is supplied to the cleaning unit, a hose configured to extend to the pump and the upper part of the cleaning unit and through which the fluid pumped by the pump flows, and a bumper formed on a side of the frame.

19 Claims, 26 Drawing Sheets

(51) Int. Cl.
*A47L 11/18* (2006.01)
*A47L 11/19* (2006.01)

(52) U.S. Cl.
CPC ..... *A47L 11/19* (2013.01); *A47L 11/4041* (2013.01); *A47L 11/4044* (2013.01); *A47L 11/4052* (2013.01); *A47L 11/4083* (2013.01); *A47L 2201/00* (2013.01)

(56) References Cited

U.S. PATENT DOCUMENTS

2008/0134458 A1* 6/2008 Ziegler ..... A47L 5/14 15/320
2008/0276408 A1* 11/2008 Gilbert, Jr. ..... A47L 11/34 15/320
2009/0044370 A1* 2/2009 Won ..... A47L 9/106 15/319

FOREIGN PATENT DOCUMENTS

WO WO 2006/089307 8/2006
WO WO 2007/028049 3/2007
WO WO 2008/091199 7/2008

OTHER PUBLICATIONS

Decision on Grant dated Jun. 22, 2016 in corresponding European Patent Application No. 13 191 446.7.
Notice of Allowance dated Jun. 15, 2017 in corresponding U.S. Appl. No. 14/075,431.
Office Action dated Dec. 9, 2016 in corresponding U.S. Appl. No. 14/075,431.
Office Action dated Jul. 14, 2016 in corresponding U.S. Appl. No. 14/075,431.
U.S. Appl. No. 14/075,431, filed Nov. 8, 2013, Du Hwan Hyun et al., Samsung Electronics Co., Ltd.
Korean Office Action dated May 22, 2019 from Korean Patent Application No. 10-2013-0067636, 11 pages.

* cited by examiner

ROBOT CLEANER

CROSS-REFERENCE TO RELATED APPLICATIONS

This application is a divisional of U.S. application Ser. No. 14/075,431, filed Nov. 8, 2013, now U.S. Pat. No. 9,795,265, which claims the benefit of Korean Patent Application Nos. 10-2012-0126898 filed on Nov. 9, 2012 in the Korean Intellectual Property Office and 10-2013-0067636, filed on Jun. 13, 2013 in the Korean Intellectual Property Office, the disclosure of which is incorporated herein by reference.

BACKGROUND

1. Field

One or more embodiments relate to a robot cleaner capable of doing a wet cleaning, and including a replaceable cleaning unit.

2. Description of the Related Art

A robot cleaner is a device for cleaning by navigating an area to be cleaned and suctioning foreign substances such as dust, etc. on a floor surface without intervention by a user. The robot cleaner determines a distance to an obstacle such as furniture, office supplies, walls, etc. installed within an area to be cleaned using a distance sensor, selectively drives a left or right wheel motor of the robot cleaner to change a direction by itself, and cleans the area to be cleaned.

Currently, a wet cleaning-type robot cleaner on which a pad is mounted to mop a floor as well as a dry cleaning-type robot cleaner sucking dust to do a dry cleaning have been implemented. In a conventional robot cleaner, a pad is fixed on a bottom surface of the robot cleaner, and the robot cleaner is moved by a driving part, so that friction force between the pad and a floor causes the floor to be cleaned. In general, the conventional robot cleaner is formed in a cylindrical shape, a pad is formed on the center of the bottom surface of the robot cleaner, and wheels are located at both ends of the pad, so that the robot cleaner navigates using the wheels, and the cleaning of the floor is done through friction between the pad and the floor.

SUMMARY

Additional aspects and/or advantages of one or more embodiments will be set forth in part in the description which follows and, in part, will be apparent from the description, or may be learned by practice of one or more embodiments of disclosure. One or more embodiments are inclusive of such additional aspects.

One or more embodiments relate to a robot cleaner in which a cleaning unit doing a wet cleaning of a bottom surface is replaceable and friction force between a pad and the bottom surface is sufficiently ensured.

In accordance with one or more embodiments, a robot cleaner may include a frame having a wheel for driving, a cleaning unit formed at a lower part of the frame to clean a surface and disposed in front of the wheel, a tank disposed at an upper part of the wheel and configured to supply fluid to the cleaning unit, a pump configured to pump the fluid contained in the tank such that the fluid contained in the tank is supplied to the cleaning unit, a hose configured to extend to the pump and the upper part of the cleaning unit and through which the fluid pumped by the pump may flow, and a bumper formed at a side of the frame, wherein the cleaning unit may be replaceable.

The frame may include a cleaning unit receiver at its lower part, and the cleaning unit may be detachably formed on the cleaning unit receiver.

The cleaning unit receiver may include a holder including a projection insertion part.

The cleaning unit may include a fixing projection inserted into the projection insertion part.

The cleaning unit may include a rotation shaft and a roll pad put into the rotation shaft to clean a bottom surface.

The rotation shaft may be rotatably mounted on the holder.

The roll pad may rotate together with the rotation shaft to clean the bottom surface when the driving part rotates the rotation shaft.

The rotation shaft may be connected to the driving part through the holder, and may rotate in a clockwise or counterclockwise direction by a driving force transferred from the driving part.

The holder may include a first holder formed on a side of the cleaning unit receiver and a second holder formed on the other side of the cleaning unit receiver, and the second holder may be formed to be opened and closed.

The second holder may include a fixing holder fixed to the other side of the cleaning unit receiver and a moving holder hinge-coupled to one side of the fixing holder.

The fixing holder and the moving holder may include a hole into which the fixing projection may be inserted, and the moving holder may be closed after the fixing projection is inserted into the hole with the moving holder opened.

The moving holder may be hook-coupled to the fixing holder.

The cleaning unit may include a first frame, a second frame hinge-coupled to the first frame, and a pad fixed between the first frame and the second frame to clean the surface.

The first frame may be hook-coupled to the second frame after the pad is disposed between the first frame and the second frame.

The pad may be a disposable pad.

In accordance with one or more embodiments, a robot cleaner may include a frame including a driving part, a wheel mounted on the frame and configured to rotate by receiving a driving force from the driving part, a cleaning unit formed in front of the wheel and detachably formed at a lower part of the frame, a tank formed at an upper part of the cleaning unit, a pump configured to pump fluid contained in the tank, and a hose connected to the pump to spray fluid to the cleaning unit.

The frame may include a cleaning unit receiver, and the cleaning unit receiver may include a holder on which the cleaning unit may be detachably mounted.

The cleaning unit may include a fixing projection formed thereon, and the holder may include a projection insertion part into which the fixing projection may be inserted.

The projection insertion part may be supported by an elastic member to be applied with an elastic force toward the cleaning unit receiver.

The wheel may repeat rotation in a clockwise or counterclockwise direction, and may drive to repeat forward or backward movement at a predetermined interval.

BRIEF DESCRIPTION OF THE DRAWINGS

These and/or other aspects will become apparent and more readily appreciated from the following description of embodiments, taken in conjunction with the accompanying drawings of which.

DETAILED DESCRIPTION

Figure 1:
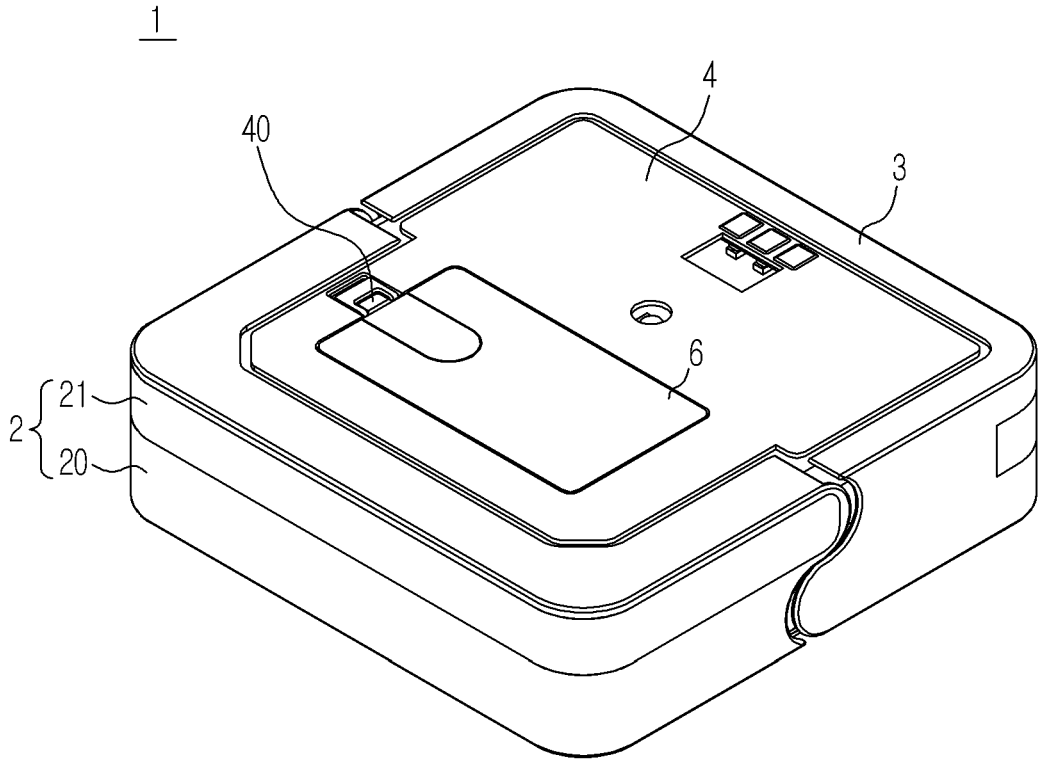
FIG. 1 is a perspective view of a robot cleaner according to one or more embodiments.

Reference will now be made in detail to one or more embodiments, illustrated in the accompanying drawings, wherein like reference numerals refer to like elements throughout. In this regard, embodiments of the present invention may be embodied in many different forms and should not be construed as being limited to embodiments set forth herein, as various changes, modifications, and equivalents of the systems, apparatuses and/or methods described herein will be understood to be included in the invention by those of ordinary skill in the art after embodiments discussed herein are understood. Accordingly, embodiments are merely described below, by referring to the figures, to explain aspects of the present invention.

A robot cleaner according to one or more embodiments will be described in detail with reference to the accompanying drawings.

Figure 2:
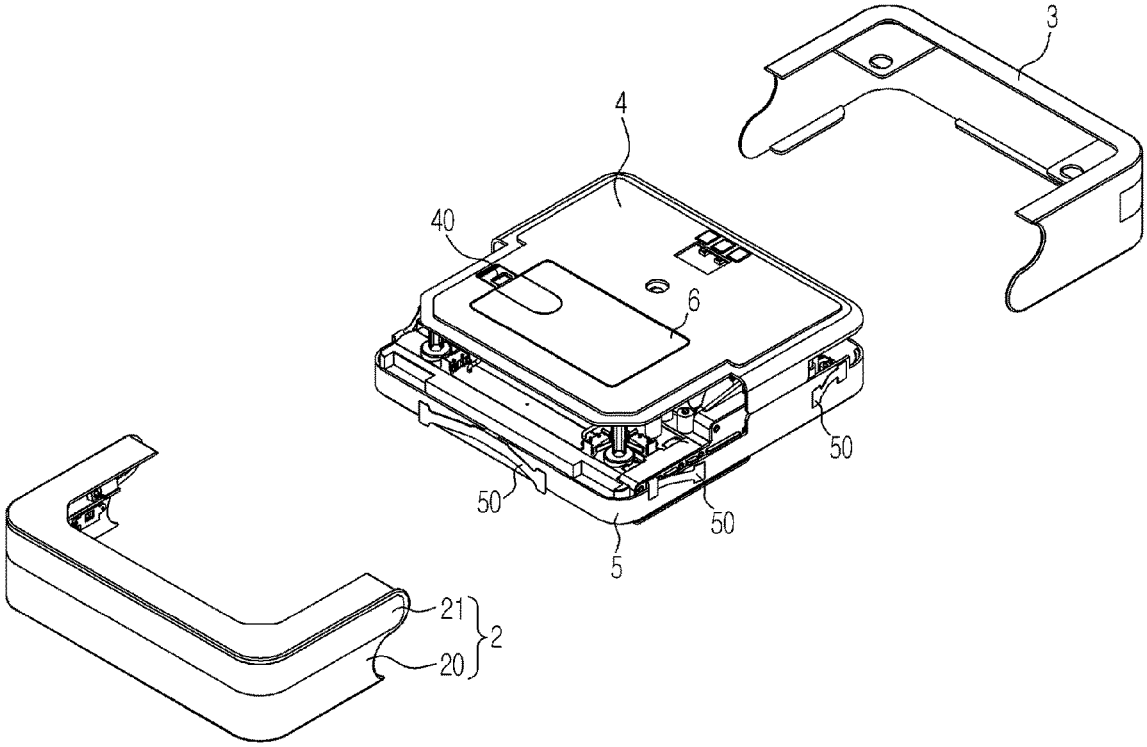
FIG. 2 illustrates a cover of the robot cleaner separated from a damper according to one embodiment of the present invention.
Figure 3:
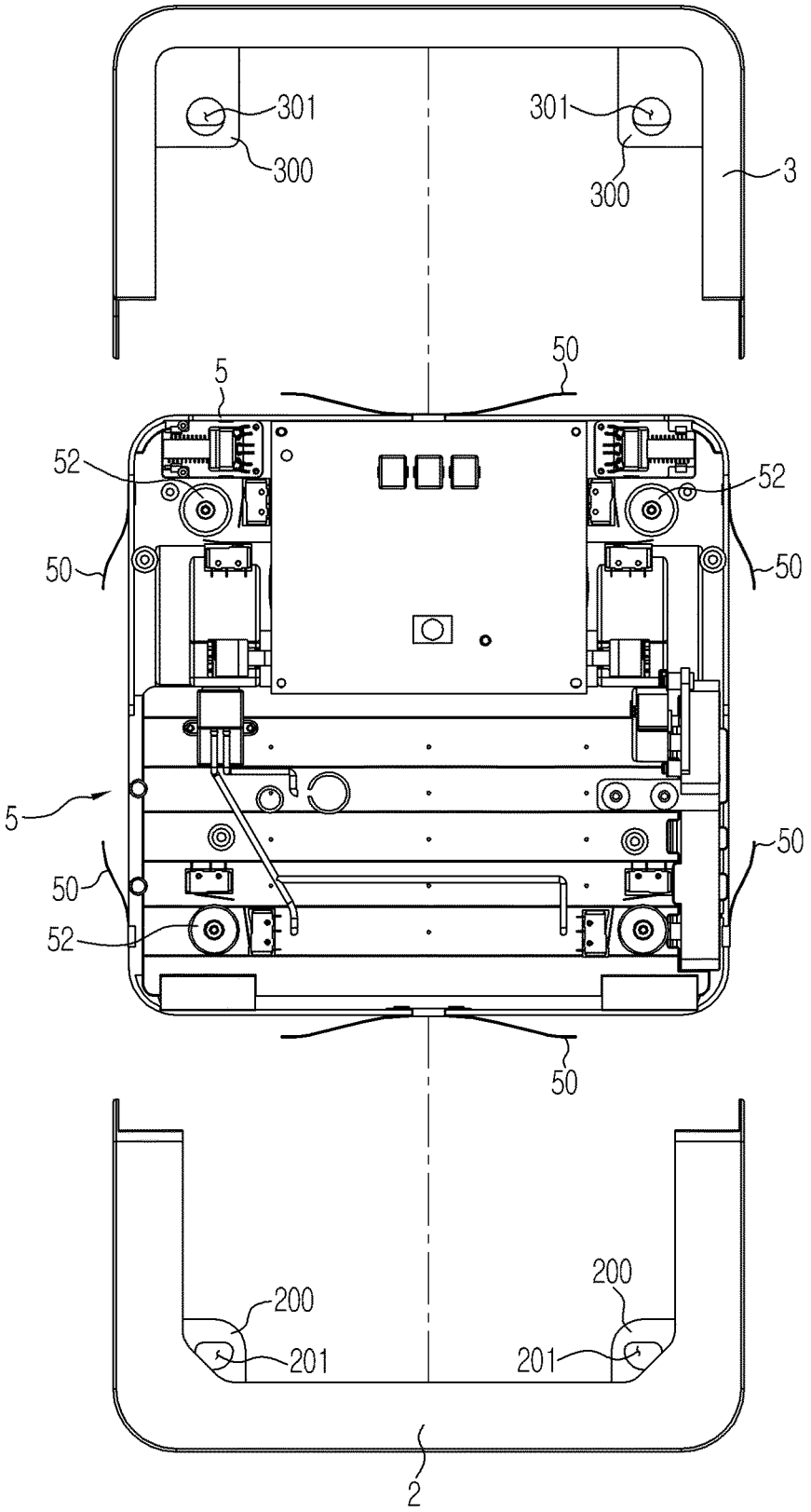
FIG. 3 illustrates a robot cleaner according to one or more embodiments from which a cover such as the cover of FIG. 2 is removed.

FIG. 1 is a perspective view of a robot cleaner according to one or more embodiments, FIG. 2 illustrates a cover of a robot cleaner according to one or more embodiments separated from a damper, and FIG. 3 illustrates the robot cleaner according to one or more embodiments from which a cover such as the cover of FIG. 2 is removed.

Referring to FIGS. 1 to 3, a robot cleaner 1 according to one or more embodiments may include bumpers 2 and 3, a cover 4, and a body. The bumpers 2 and 3 and the cover 4 may form an appearance of the robot cleaner 1. The bumpers 2 and 3 and the cover 4 may cover a frame 5. As illustrated, for example, in FIGS. 1 to 3, the bumpers 2 and 3 and/or the frame 5 may be substantially rectangular in shape and having beveled or rounded corners.

Figure 9:
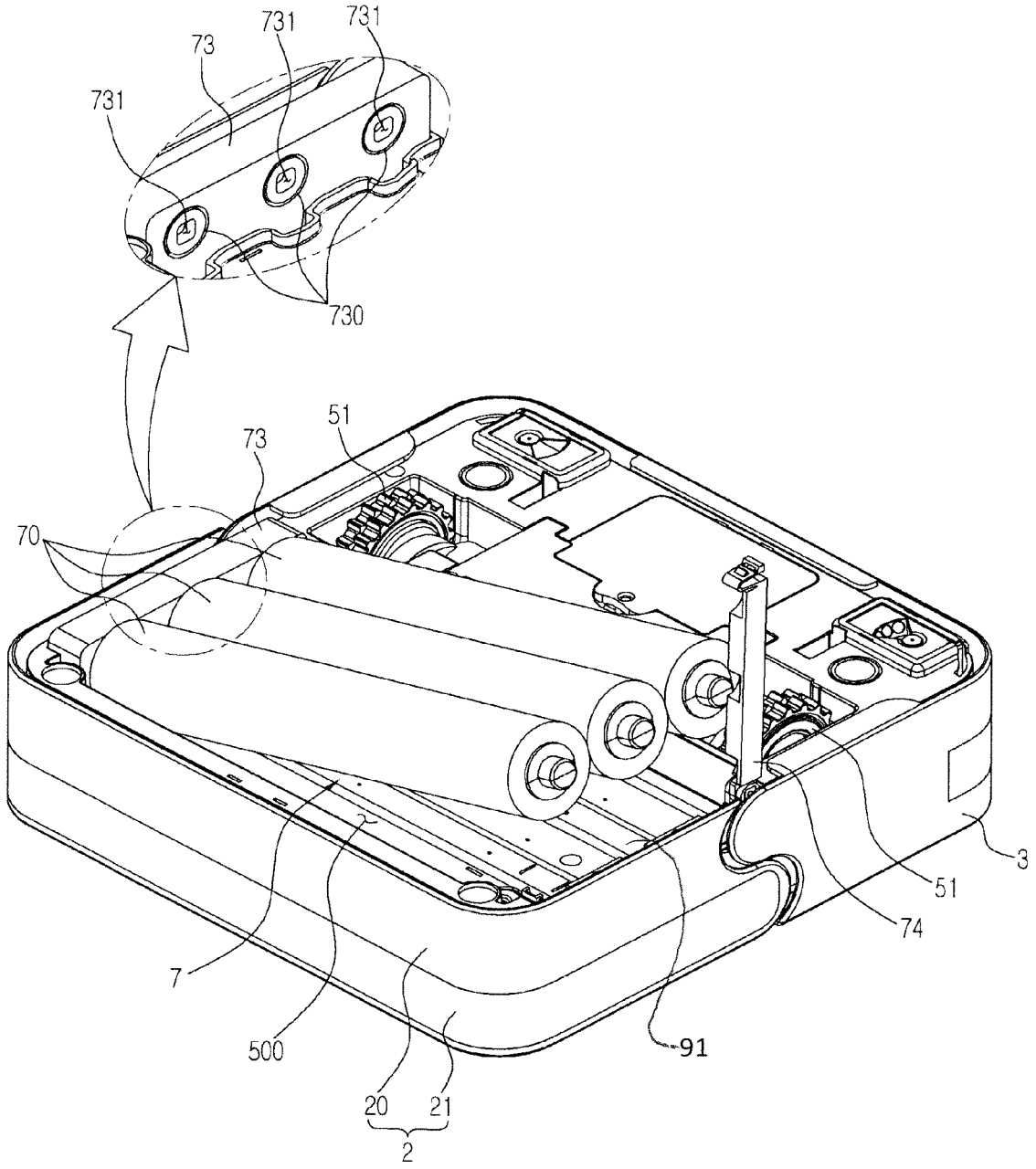
FIG. 9 illustrates a roll pad assembly mounted on a bottom surface of the robot cleaner according to one or more embodiments.

The body of the robot cleaner may include a driving part, a cleaning unit 91, a control part and a wheel 51 (see FIG. 9). The driving part, the cleaning unit 91, the control part and the wheel 51 may be formed on the frame 5. The wheel 51 may receive driving force from the driving part to rotate, so that the robot cleaner 1 moves. The wheel 51 and the cleaning unit 91 may be sequentially disposed. For example, the wheel 51 may be disposed behind the cleaning unit 91.

The bumpers 2 and 3 may include a front bumper 2 and a rear bumper 3. The front bumper 2 may be disposed in a front side of the robot cleaner 1 with respect to a forward direction in which the robot cleaner 1 moves, and the rear bumper 3 may be disposed in a backside of the robot cleaner 1 with respect to the forward direction of the robot cleaner 1. The bumpers 2 and 3 may reduce a bumping impact caused when the robot cleaner 1 collides with obstacles.

The cover 4 may cover a top surface of the robot cleaner 1. The cover 4 may include a tank receiver 41 (see FIG. 5), and a tank 6 may be received in the tank receiver 41. The tank receiver 41 may be concavely formed toward the frame 5 to correspond to the size of the tank 6 such that a top surface of the tank 6 may be formed on the same planar surface as that of the cover 4.

A latch 40 capable of fixing the tank 6 may be formed on a side of the cover 4. The latch 40 may be formed to separate the tank 6 from the tank receiver 41 by operating the latch 40.

For example, the latch 40 may be formed to protrude toward the tank receiver 41, and an elastic member applying an elastic force may be formed on a side of the latch 40 such that the latch 40 faces toward the tank receiver 41. A user may push the latch 40 in an opposite direction to the elastic force to lead the tank 6 into the tank receiver 41. When the tank 6 is completely set into the tank receiver 41, the latch 40 may move toward the tank 6 by the elastic force of the elastic member, so that the tank 6 may be fixed to the tank receiver 41 without deviation. Here, a groove may be formed on the tank 6 such that a part of the latch 40 may be inserted. When the tank 6 is completely received in the tank receiver 41, a part of the latch 40 may be inserted into the groove, so that the tank 6 may be fixed. After the user applies a force in an opposite direction to the elastic force to the latch 40 so that the latch 40 is disposed not to interrupt the tank 6, the tank 6 may be separated from the tank receiver 41.

An elastic member 50 may be formed on the outside of the frame 5. The elastic member 50 may be formed on a front or rear side of the frame 5. When the frame 5 is formed in a quadrilateral shape, each elastic member 50 may be formed on each of the four outside surfaces.

The elastic member 50 may be formed to be disposed between an outer surface of the frame 5 and internal surfaces of the bumpers 2 and 3. The elastic member 50 may provide an elastic force to the bumpers 2 and 3 such that the elastic member 50 may absorb an impact on the bumpers 2 and 3 when the bumpers 2 and 3 collide with external obstacles during the driving of the robot cleaner 1, and may reduce the impact to the frame 5. The elastic member 50 may be formed, for example, as a leaf spring.

Figure 4:
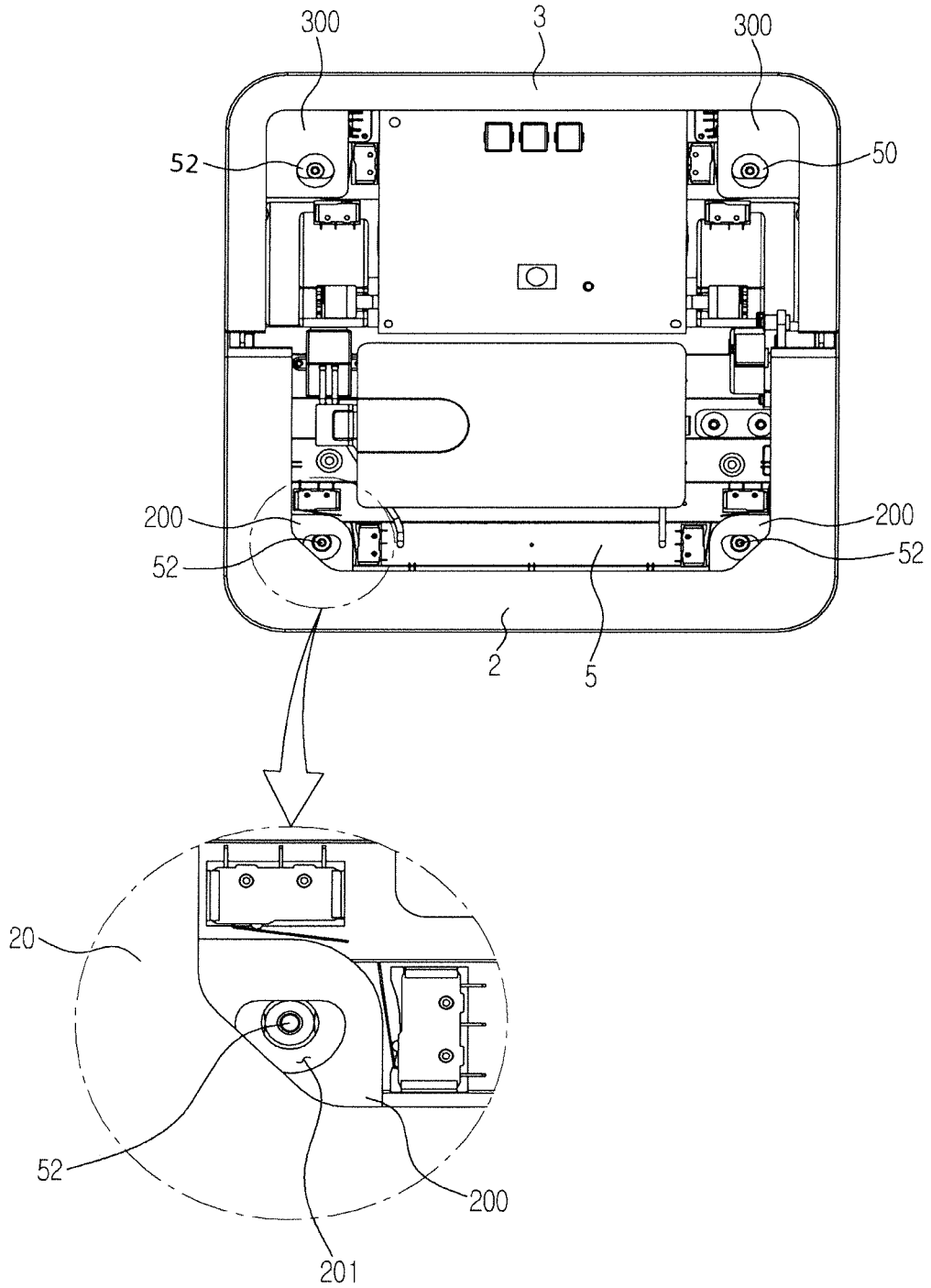
FIG. 4 illustrates a bumper of robot cleaner according to one or more embodiments mounted on a frame according to one or more embodiments.
Figure 5:
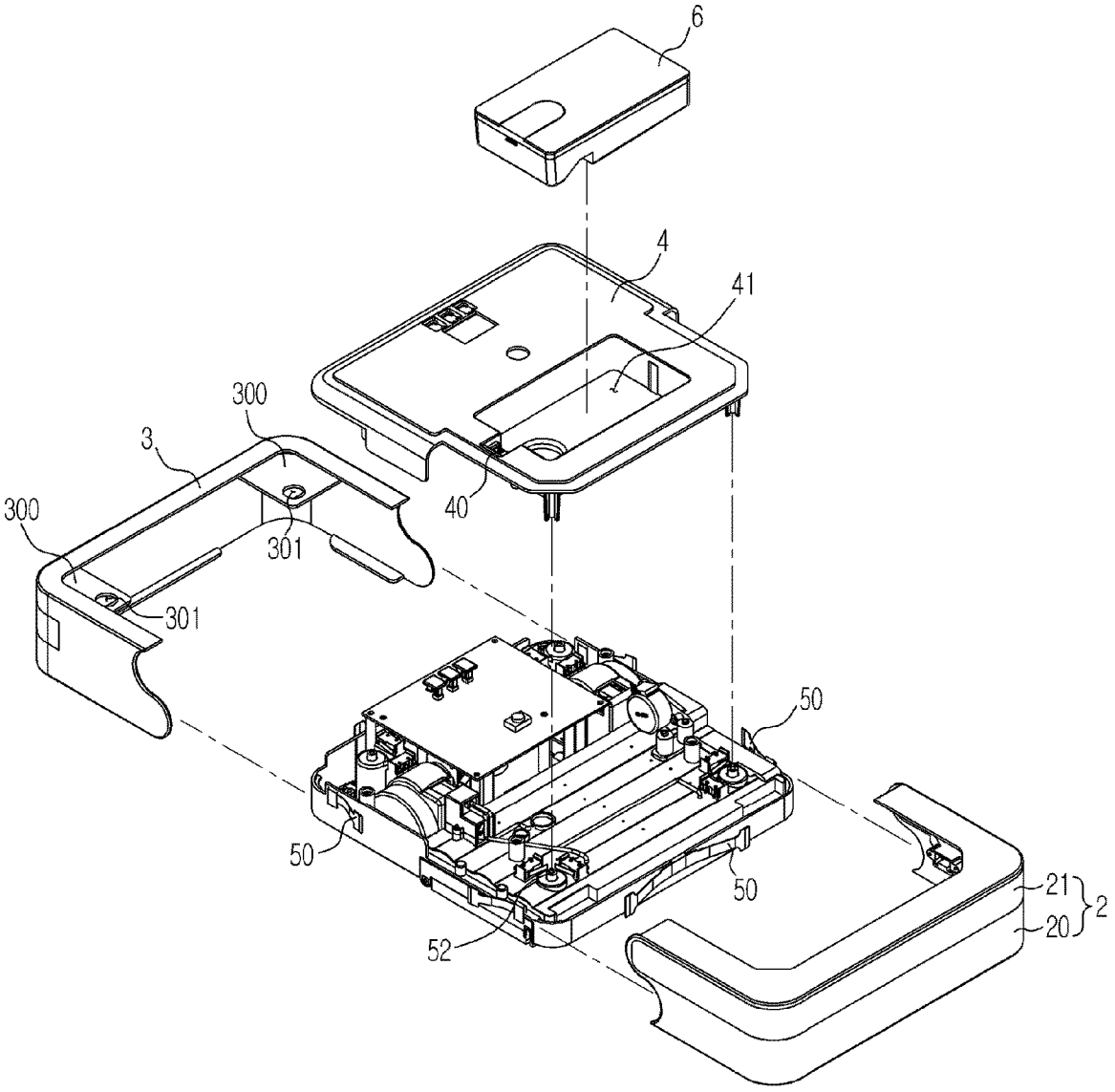
FIG. 5 illustrates the bumper of a robot cleaner according to one or more embodiments separated from the frame according to one or more embodiments.

FIG. 4 illustrates a bumper of a robot cleaner according to one or more embodiments such as the robot cleaner 1 mounted on the frame according to one or more embodiments, and FIG. 5 illustrates the bumper of a robot cleaner separated from the frame according to one or more embodiments.

Referring to FIGS. 4 and 5, the bumpers 2 and 3 according to one or more embodiments may be movably mounted on the frame 5. Projections 200 and 300 including fixing holes 201 and 301 thereon may be formed on the internal surfaces of the bumpers 2 and 3. A fixing part 52 may be formed to protrude on the top surface of the frame 5. The fixing part 52 may be connected to the bumpers 2 and 3 and the frame 5 to be fixed by being inserted into the fixing holes 201 and 301.

Here, the diameter of the fixing holes 201 and 301 may be greater than that of a cross-section of the fixing part 52. When the fixing part 52 is inserted into the fixing holes 201 and 301, the fixing part 52 may be formed to move in the fixing holes 201 and 301. When the bumpers 2 and 3 collide with obstacles during the driving of the robot cleaner 1, the bumpers 2 and 3 may move, so that the impact on the bumpers 2 and 3 may be reduced due to the elastic member 50 formed on the external surface of the frame 5. As a result, a degree of the impact on the frame 5 may be reduced.

Figure 6:
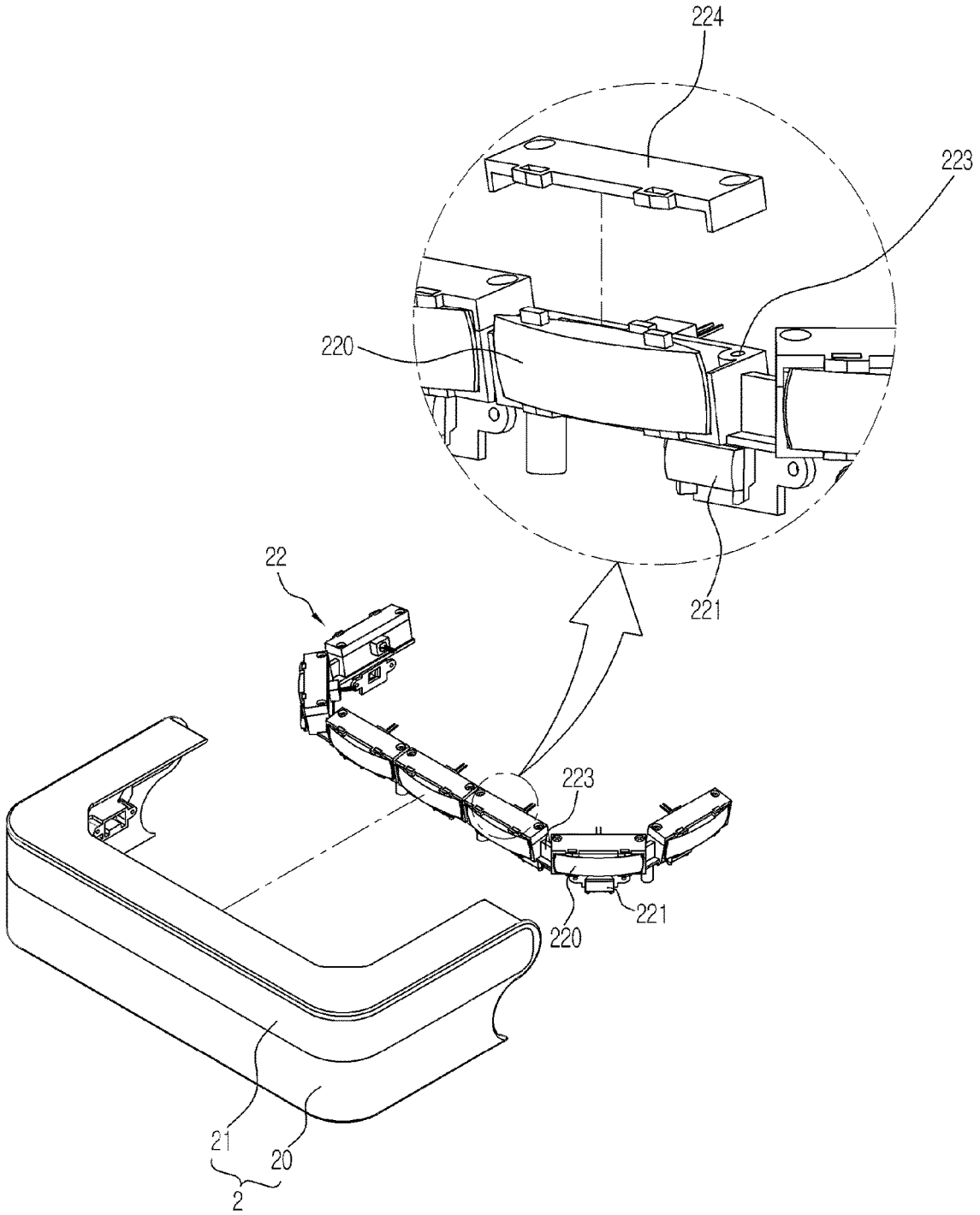
FIG. 6 is an exploded perspective view of a front bumper and an obstacle detection sensor assembly according to one or more embodiments.
Figure 7:
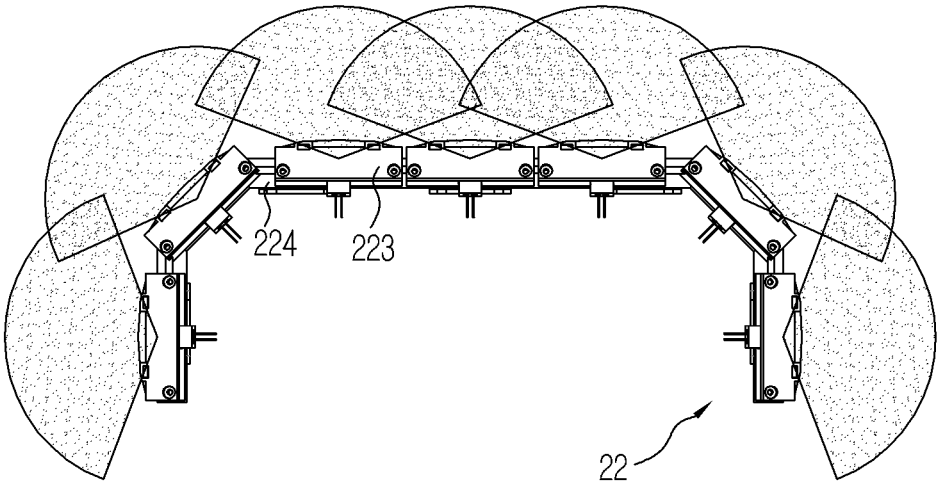
FIG. 7 illustrates a sensing region of the obstacle detection sensor assembly according to one or more embodiments.

FIG. 6 is an exploded perspective view of the front bumper and an obstacle detection sensor assembly according to one or more embodiments, and FIG. 7 illustrates a sensing region of the obstacle detection sensor assembly according to one or more embodiments.

Referring to FIGS. 6 and 7, the front bumper 2 according to one or more embodiments may include an obstacle detection sensor assembly 22. When a forward obstacle is sensed by the obstacle detection sensor assembly 22 during the driving of the robot cleaner 1, a controller may change a direction in which the robot cleaner 1 navigates. As a result, the robot cleaner 1 may avoid the obstacle and continue to drive.

A transparent window 21 may be formed on a side of the front bumper 2. The transparent window 21 may be disposed on an upper part of the front bumper 2. For example, the front bumper 2 may include a bumper body 20 and the transparent window 21, the bumper body 20 may include an opening on its upper part, and the transparent window 21 may be mounted on the opening of the bumper body 20. The obstacle detection sensor assembly 22 may send a signal in the front direction of the robot cleaner 1 through the transparent window 21, and may receive a signal reflected from the obstacle.

The obstacle detection sensor assembly 22 may include a receiver 220, a light emission part 221, and a sensor frame 223. The receiver 220 and the light emission part 221 may be mounted on the sensor frame 223. For example, the light emission part 221 may be mounted on a lower part of the sensor frame 223, and the receiver 220 may be mounted on an upper part of the sensor frame 223.

A guide cover 224 may be further formed on an upper part of the receiver 220. The guide cover 224 may cover the upper part of the receiver 220, and may receive only a signal reflected from an obstacle to possibly detect the obstacle disposed in a front direction. The signal received by the receiver 220 may be transferred to a controller (not shown), and the controller (not shown) may be formed to change the direction in which the robot cleaner 1 moves.

The obstacle detection sensor assembly 22 may include a plurality of receivers 220 and a plurality of light emission parts 221. The sensor frame 223 may include a space in which the plurality of receivers 220 and the plurality of light emission parts 221 may be mounted. Further, the plurality of receivers 220 may be disposed on an upper part of the sensor frame 223, and the plurality of light emission parts 221 may be disposed at a lower part of the sensor frame 223.

The plurality of receivers 220 and the plurality of light emission parts 221 may be formed along the entire front surface of the robot cleaner 1 such that it may detect an obstacle disposed in the front direction of the robot cleaner 1. The plurality of receivers 220 and the plurality of light emission parts 221 may be disposed at a part of both sides of the robot cleaner 1. The plurality of receivers 220 and the plurality of light emission parts 221 may be formed along the entire front surface disposed in the front direction of the robot cleaner 1, and as illustrated in FIG. 7, they may detect the obstacle disposed in the front direction of the robot cleaner 1.

Figure 8:
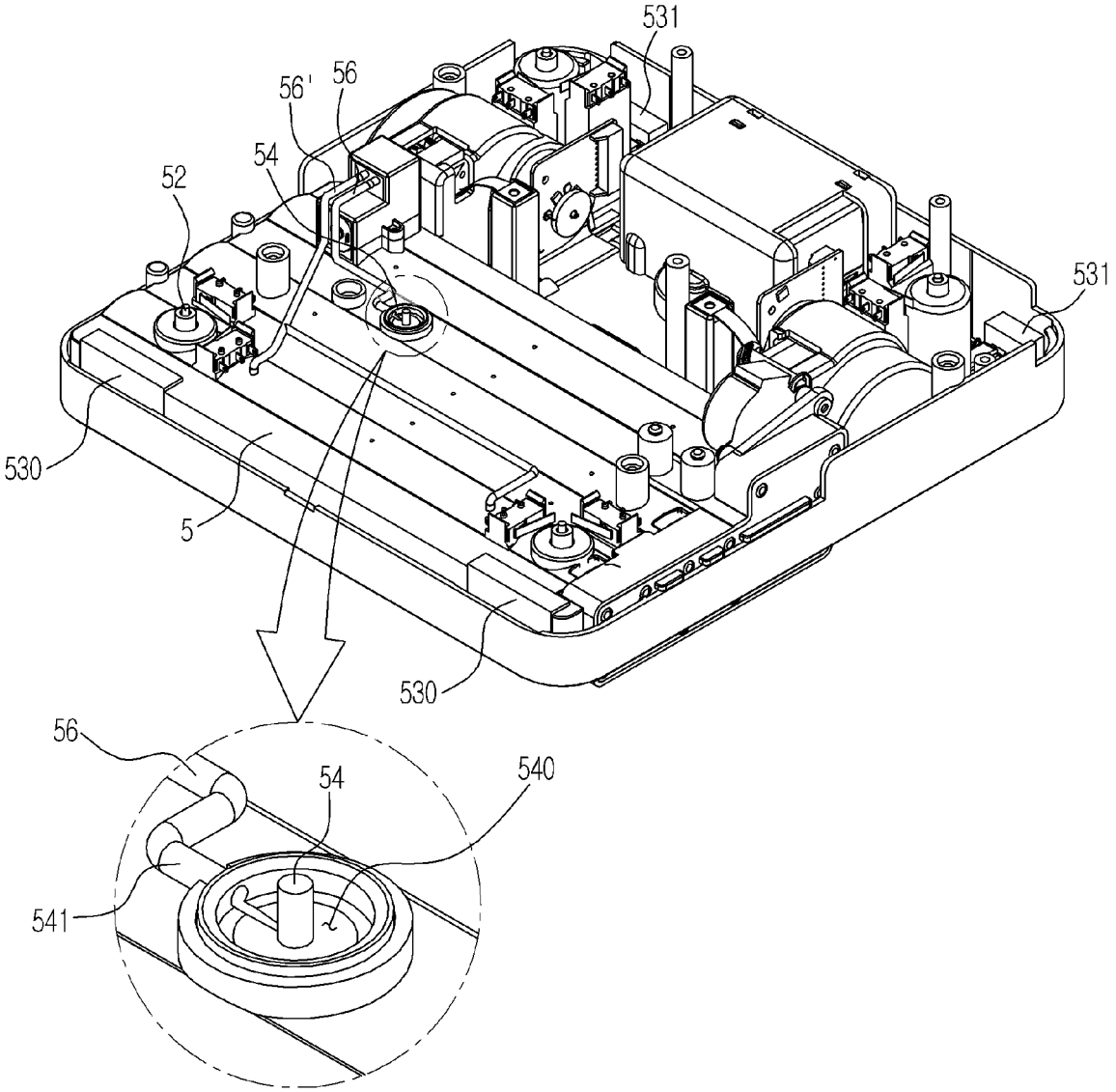
FIG. 8 illustrates a sensor mounted on a frame according to one or more embodiments.

FIG. 8 illustrates a sensor mounted on a frame according to one or more embodiments.

Referring to FIG. 8, a front sensor 530 and a rear sensor 531 may be mounted on the frame 5 according to one or more embodiments. At least one of the front sensor 530 and the rear sensor 531 may be a falling sensor. The falling sensor may include, for example, at least one of an ultrasonic sensor, a camera sensor, and an optical mouse sensor, etc. For example, the front sensor 530 may be an ultrasonic sensor or camera sensor. The rear sensor 531 may, for example, be an optical mouse sensor.

A camera sensor may further sense the pollution level of a roll pad formed on the robot cleaner 1. The optical mouse sensor may sense a distance of movement of the robot cleaner 1. In a conventional robot cleaner, an encoder is mounted on a wheel motor to measure a movement distance based on the number of wheel rotations. However, when the robot cleaner 1 slides depending on a state of a floor, an exact movement distance would not be easily sensed. according to one or more embodiments, the camera sensor may enable a movement distance of the robot cleaner 1 to be sensed.

A pressure part 54 may project from an upper part of the frame 5 to pressurize a cap 64 mounted on a bottom surface of the tank 6 to be described below. The description of the pressurization of the cap 64 of the tank 6 by the pressure part 54 will be provided below.

Figure 10:
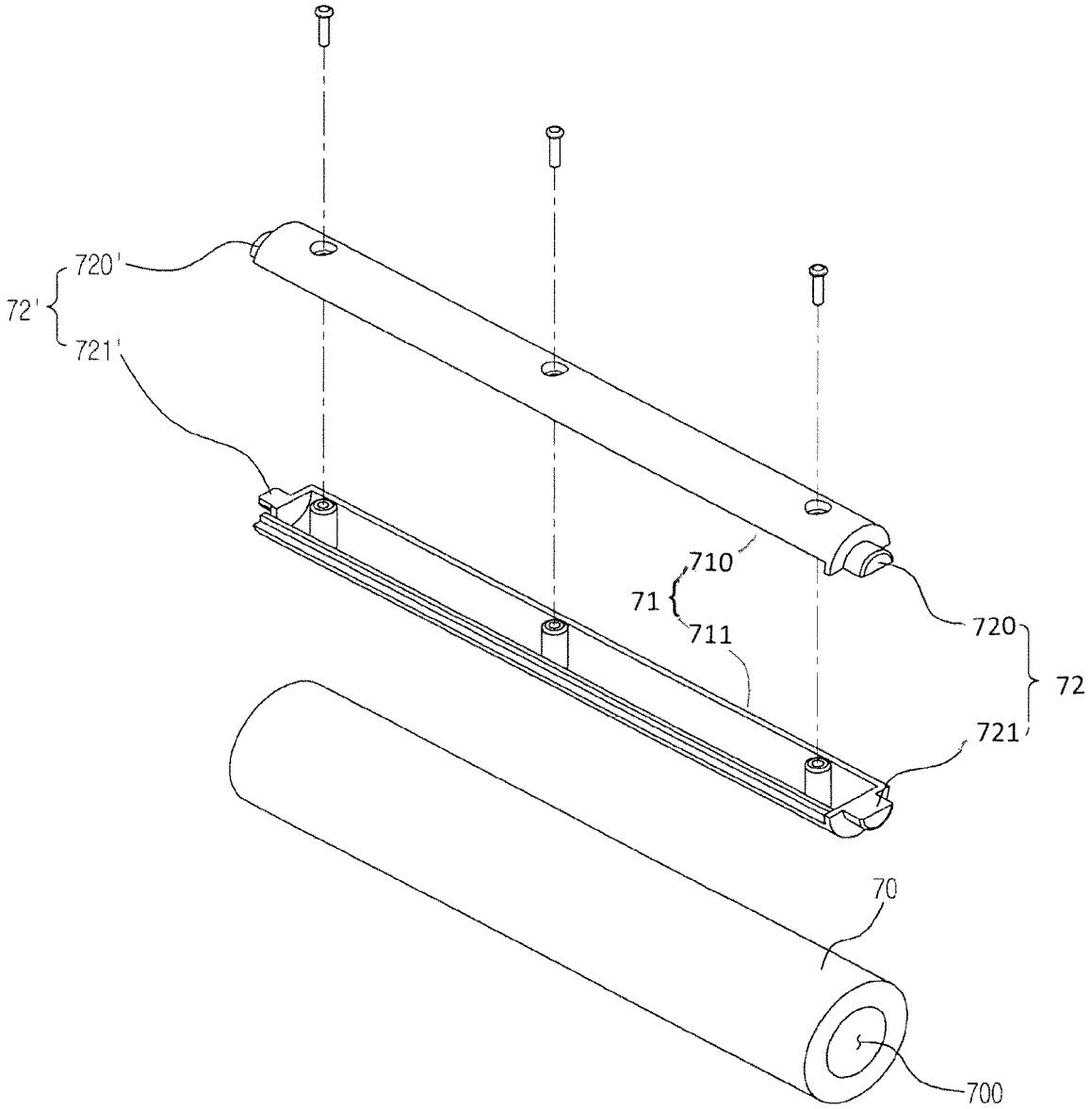
FIG. 10 is an exploded perspective view of the roll pad assembly according to one or more embodiments.
Figure 11:
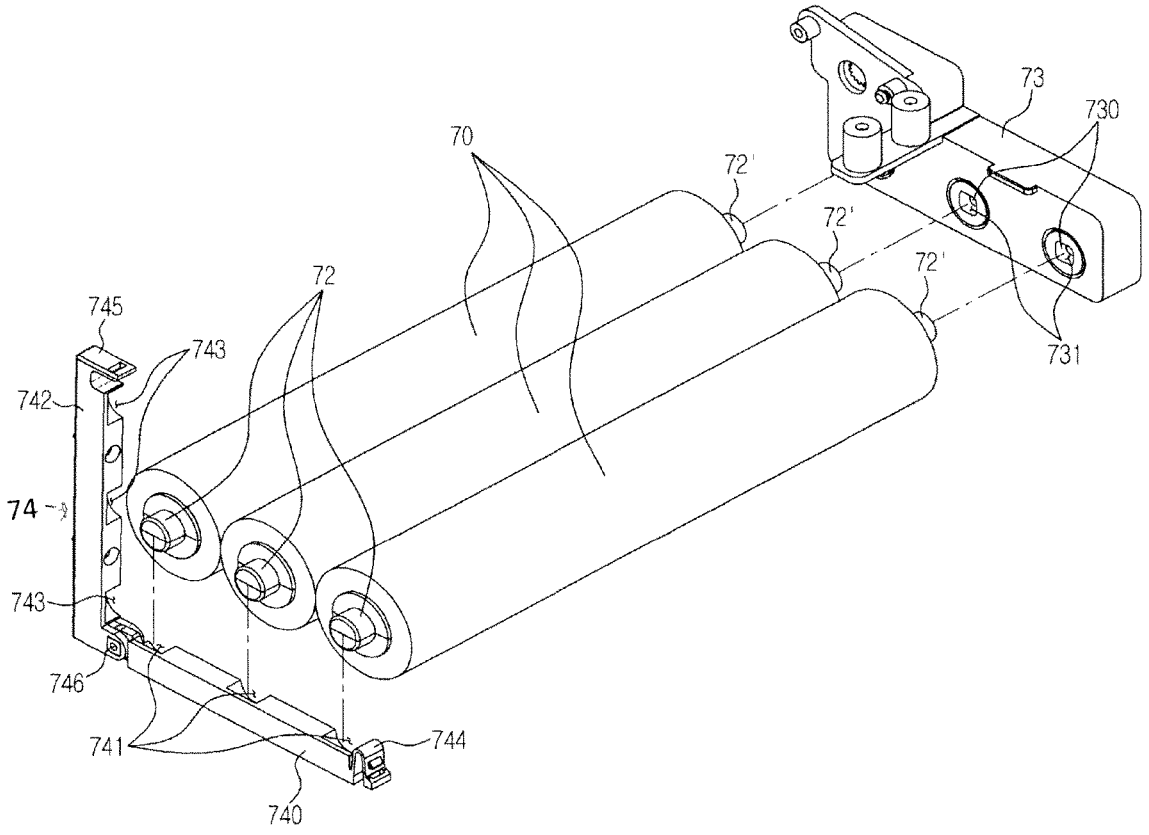
FIG. 11 illustrates the roll pad assembly mounted on a holder according to one or more embodiments.

FIG. 9 illustrates a roll pad assembly mounted on a bottom surface of the robot cleaner according to one or more embodiments, FIG. 10 is an exploded perspective view of the roll pad assembly according to one or more embodiments, and FIG. 11 illustrates the roll pad assembly mounted on a holder according to one or more embodiments.

Referring to FIGS. 9 to 11, the robot cleaner 1 according to one or more embodiments may include a roll pad assembly 7. The roll pad assembly 7 may be formed on a lower surface of the frame 5 to clean a floor. A plurality of roll pad assemblies 7 may be formed on a lower surface of the frame 5. The roll pad assembly 7 may rotate in a clockwise or counterclockwise direction, so that the floor is cleaned.

The roll pad assembly 7 according to one or more embodiments may include a roll pad 70 and a rotation shaft 71. The roll pad 70 may include a projection insertion part 700, and the rotation shaft 71 may be inserted into the projection insertion part 700 to be fixed such that the rotation shaft 71 rotates together with the roll pad 70. The rotation shaft 71 may be rotatably mounted on holders 73 and 74 formed on the frame 5. As a result, the roll pad 70 may be mounted on the bottom surface of the frame 5 to clean the floor.

For example, the rotation shaft 71 may include a first rotation shaft 710 and a second rotation shaft 711. The first rotation shaft 710 may be formed to correspond to the second rotation shaft 711, and when the first rotation shaft 710 and the second rotation shaft 711 are coupled by a connection member, they may form the rotation shaft 71 in the shape of a bar. The rotation shaft 71 may be integrally injection molded.

Fixing projections 72 and 72' that may be inserted into the holders 73 and 74 may be formed at each end of the rotation shaft 71. For example, when the rotation shaft 71 is formed by coupling the first rotation shaft 710 to the second rotation shaft 711, the fixing projection 72 may include a first fixing projection 720 formed at one end of the first rotation shaft 710 and a second fixing projection 721 formed at one end of the second rotation shaft 711. When the first rotation shaft 710 is coupled to the second rotation shaft 711, the first fixing projection 720 and the second fixing projection 721 may be formed as a single fixing projection 72.

Likewise, when the first rotation shaft 710 is coupled to the second rotation shaft 711, a first fixing projection 720' formed at the other end of the first rotation shaft 710 and a second fixing projection 721' formed at the other end of the second rotation shaft 711 may be formed as a single fixing projection 72'.

The roll pad 70 may be coupled to the rotation shaft 71 to form the roll pad assembly 7. A plurality of roll pad assemblies may be formed at a bottom surface of the frame 5.

A cleaning unit receiver 500 in which the roll pad assembly may be received may be formed at the bottom surface of the frame 5. The holders 73 and 74 in which the roll pad assembly may be mounted may be formed on sidewalls constituting the cleaning unit receiver 500.

The holders 73 and 74 may include a first holder 73 and a second holder 74. The first holder 73 may be formed on a sidewall of the frame 5 constituting the cleaning unit receiver 500, and the second holder 74 may be formed on the other sidewall of the frame 5 constituting the cleaning unit receiver 500. A distance from a surface of the first holder 73 to one surface of the second holder 74 facing the surface of the first holder 73 may be less than or equal to a length of the rotation shaft 71 together with a length of the fixing projection 72.

A projection insertion part 730 through which a groove 731 is formed such that the fixing projection 72' formed on the other side of the rotation shaft 71 may be inserted may be on the first holder 73. When the fixing projection 72' is inserted into the groove 731, the rotation shaft 71 and the projection insertion part 730 are formed to rotate together. For example, an interruption part may be formed in the groove 731, and a projection part interrupted by the interruption part may be formed on the fixing projection 72', so that the projection part is interrupted by the interruption part. The projection insertion part 730 may be connected to a driving part to rotate, and when the projection insertion part 730 rotates, the rotation shaft 71 may rotate as well. The projection insertion part 730 may be supported by an elastic member (not shown) formed in the first holder 73.

The second holder 74 may include a fixing holder 740 fixed on the other sidewall of the cleaning unit receiver 500 of the frame 5 and a moving holder 742 coupled by a hinge 746 to one side of the fixing holder 740.

A first hole 741 including a part of a hole into which the fixing projection 72 formed on a side of the rotation shaft 71 may be inserted may be formed on the fixing holder 740. A second hole 743 including the other part of the hole into which the fixing projection 72 formed on a side of the rotation shaft 71 may be inserted may be formed on the moving holder 742. When the fixing projection 72 is disposed in the first hole 741 and the moving holder 742 rotates with respect to the hinge 746 to be coupled to the other side of the fixing holder 740, the first hole 741 and the second hole 743 may constitute one hole, and the fixing projection 72 of the rotation shaft 71 may be inserted into the hole.

The fixing projection 72' formed on the other side of the rotation shaft 71 may be inserted into the groove 731, the fixing projection 72 formed on one side of the rotation shaft 71 may be disposed in the first hole 741 formed on a side of the second holder 74, and the moving holder 742 may be rotated with respect to the hinge 746 to be coupled to the other side of fixing holder 740, so that the roll pad assembly 7 may be mounted on the cleaning unit receiver 500.

When the fixing projection 72 is disposed in the first hole 741 with the fixing projection 72' inserted into the groove 731, the projection insertion part 730 formed in the first holder 73 may be pushed inwardly in the direction of the first holder 73, and the projection insertion part 730 may move toward the cleaning unit receiver 500 by an elastic force of an elastic member (not shown) formed in the first holder 73 after the fixing projection 72 is disposed in the first hole 741. As a result, the rotation shaft 71 of the roll pad assembly 7 may be fixed to the holders 73 and 74.

The other side of the fixing holder 740 may be hook-coupled to that of the moving holder 742. A first hook part 744 projecting vertical to a longitudinal direction of the fixing holder 740 may be formed on the other side of the fixing holder 740, and a second hook part 745 to which the first hook part 744 may be inserted to be fixed may be formed on the other side of the moving holder 742. When the moving holder 742 rotates with respect to the hinge 746 to be in contact with the fixing holder 740, the first hook part 744 may be inserted into the second hook part 745 to be fixed thereto. As a result, the moving holder 742 may be coupled to the fixing holder 740 to fix the roll pad assembly 7 to the bottom surface of the frame 5.

The roll pad assembly 7 may be separated from the cleaning unit receiver 500. The coupling of the first hook part 744 to the second hook part 745 may be released, and the roll pad assembly 7 may be pressurized toward the first holder 73 to separate the roll pad assembly 7 from the cleaning unit receiver 500. The used contaminated roll pad assembly 7 may be replaced with a new roll pad assembly. Since the roll pad assembly 7 is detachably mounted on the frame 5, a sanitary cleaning of the floor may be accomplished through a cleaning unit 91 that is clean.

Figure 12:
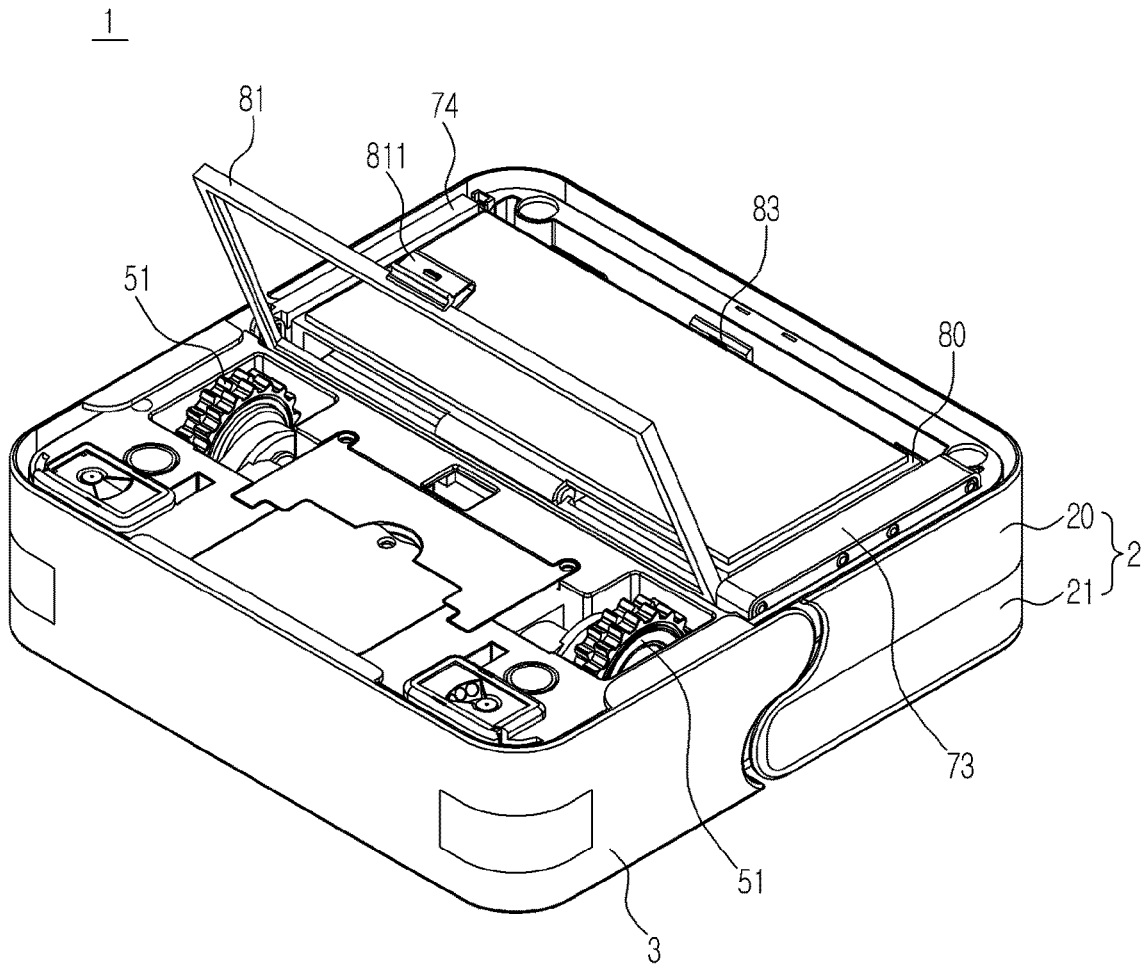
FIG. 12 illustrates a mounted pad assembly according to one or more embodiments.
Figure 13:
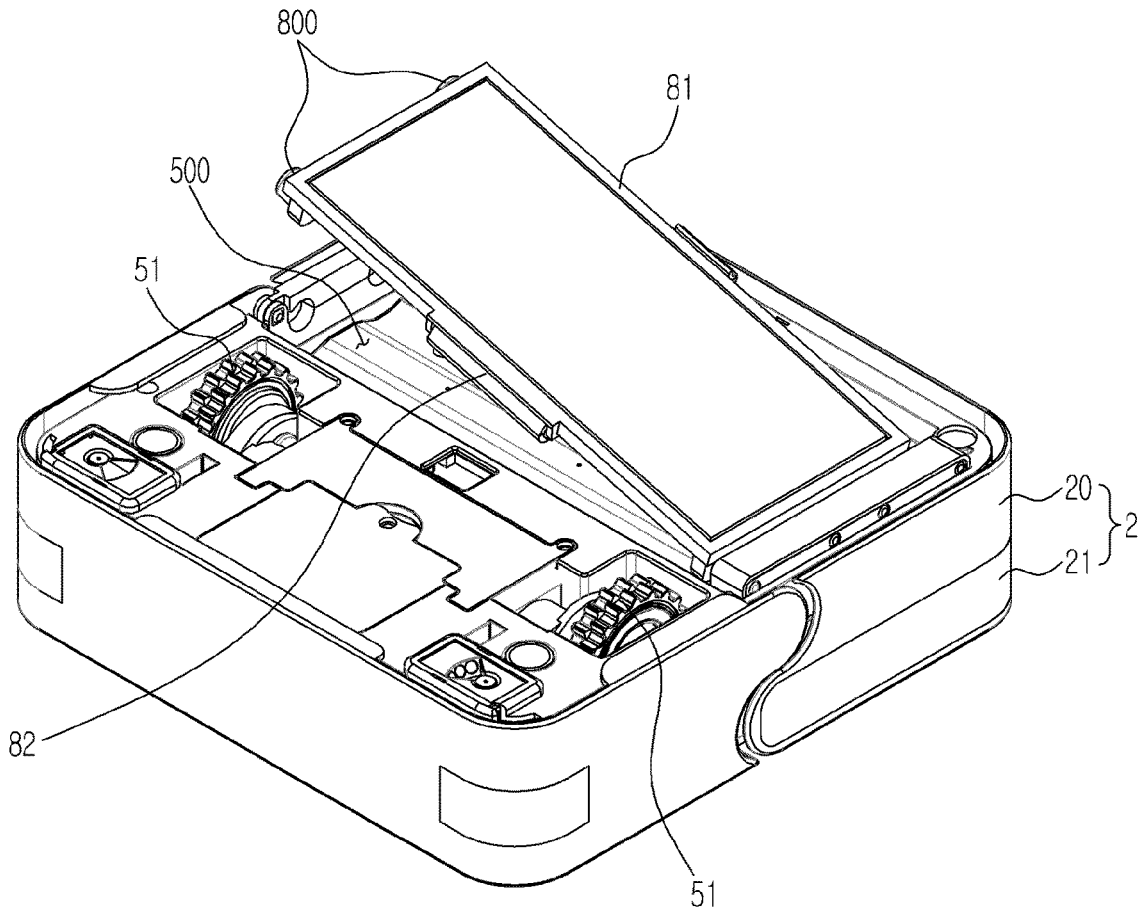
FIG. 13 illustrates a pad assembly mounted on a holder according to one or more embodiments.
Figure 14:
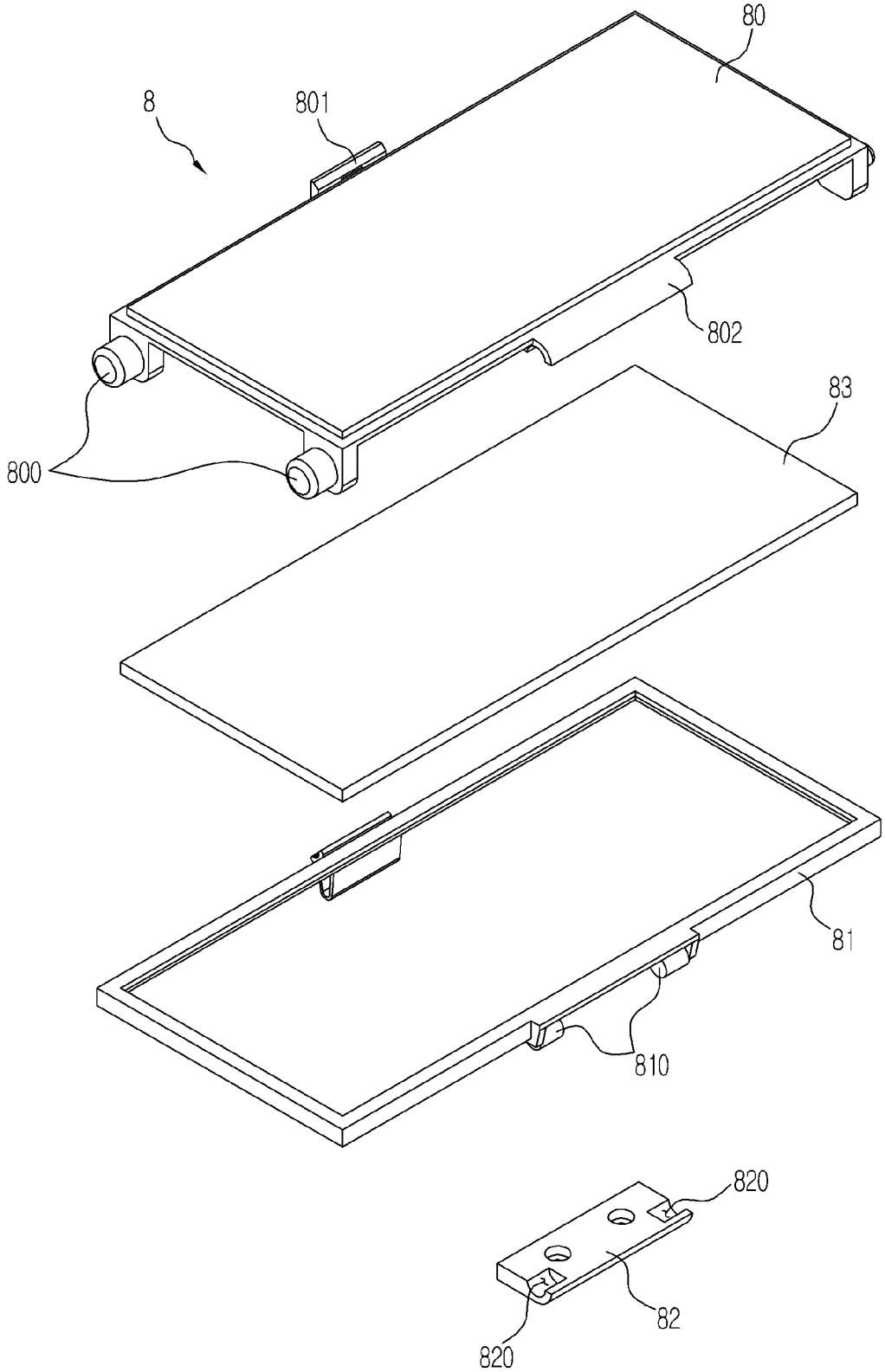
FIG. 14 is an exploded perspective view of a pad assembly according to one or more embodiments.

FIG. 12 illustrates a mounted pad assembly according to one or more embodiments, FIG. 13 illustrates a pad assembly mounted on a holder according to one or more embodiments, and FIG. 14 is an exploded perspective view of a pad assembly according to one or more embodiments.

Referring to FIGS. 12-14, a pad assembly 8 according to one or more embodiments may include a first pad frame 80, a second pad frame 81 and a hinge device 82. The first pad frame 80 may be coupled to the second pad frame 81 to rotate with respect to the center of a rotation shaft 810 of the second pad frame 81.

The pad assembly 8 according to one or more embodiments may be received in the cleaning unit receiver 500 according to one or more embodiments to be fixed thereto. The cleaning unit receiver 500 formed on the frame 5 may receive the roll pad assembly 7 according to one or more embodiments or the pad assembly 8 according to one or more embodiments, so that the floor is cleaned. Hereinafter, the roll pad assembly 7 and the pad assembly 8 may be referred to as a cleaning unit.

A pad 83 may be disposed on the first pad frame 80. When the pad 83 is disposed on the first pad frame 80 with the second pad frame 81 opened, the second pad frame 81 may rotate to be closed and may be coupled to the first pad frame 80, so that the pad 83 disposed on the first pad frame 80 may be fixed. The pad 83 may be formed to be larger than a surface area of the first pad frame 80.

The first pad frame 80 may include one or more fixing projections 800 which may be mounted to the holders 73 and 74. The description of the holders 73 and 74 according to one or more embodiments may be applied in a similar manner to the holders 73 and 74 discussed above. However, the projection insertion part 730 formed on a side of the first holder 73 may not rotate by the driving part. The fixing projection 800 may be inserted into grooves formed on the holders 73 and 74 to be fixed.

The second pad frame 81 may be rotatably coupled to the first pad frame 80 through the hinge device 82. For example, a hinge device connector 802 may be formed on a side of the first pad frame 80. A rotation shaft 810 may be formed on a side of the second pad frame 81, and a groove 820 in which the rotation shaft 810 may be disposed may be formed on the hinge device 82. When the rotation shaft 810 is disposed in the groove 820 formed on the hinge device 82, the first pad frame 80 may be coupled to the hinge device connector 802 and the hinge device 82. As a result, the second pad frame 81 may be rotatably coupled to the first pad frame 80.

The first pad frame 80 and the second pad frame 81 may include hook parts 801 and 811. The hook parts 801 and 811 may be disposed on a position facing the hinge device 82. The first hook part 801 may be formed on the first pad frame 80, and the second hook part 811 may be formed on the second pad frame 81. The second hook part 811 may be formed to protrude from the second pad frame 81. The first hook part 801 may include a groove (not shown) into which a part of the second hook part 811 may be inserted to be fixed. When the second pad frame 81 rotates with respect to the rotation shaft 810 to be closed, the second hook part 811 may be inserted into the groove formed on the first hook part 801 to be fixed.

The user may open the first pad frame 80 to dispose the pad 83 on the first pad frame 80, and then may rotate the second pad frame 81, and may apply force with the second pad frame 81 closed to couple the second hook part 811 to the first hook part 801, so that the pad 83 may be fixed to the pad assembly 8. After the pad assembly 8 on which the pad 83 is mounted is fixed to the frame 5, the robot cleaner 1 may navigate to clean. Here, a disposable pad may be used as the pad 83.

When the pad 83 is changed, the user may separate the pad assembly 8 from the frame 5, or open the second pad frame 81 with the pad assembly 8 fixed to the frame 5 to separate the contaminated pad from the first pad frame 80, dispose a new pad on the first pad frame 80, and close the second pad frame 81 to fix the pad. When the new pad is fixed between the first pad frame 80 and the second pad frame 81, the user may drive the robot cleaner 1 so that the floor is cleaned by the new pad. In the above manner, the user may replace the used pad with the new pad, so that the cleaning of the floor is done by the robot cleaner 1.

Figure 15:
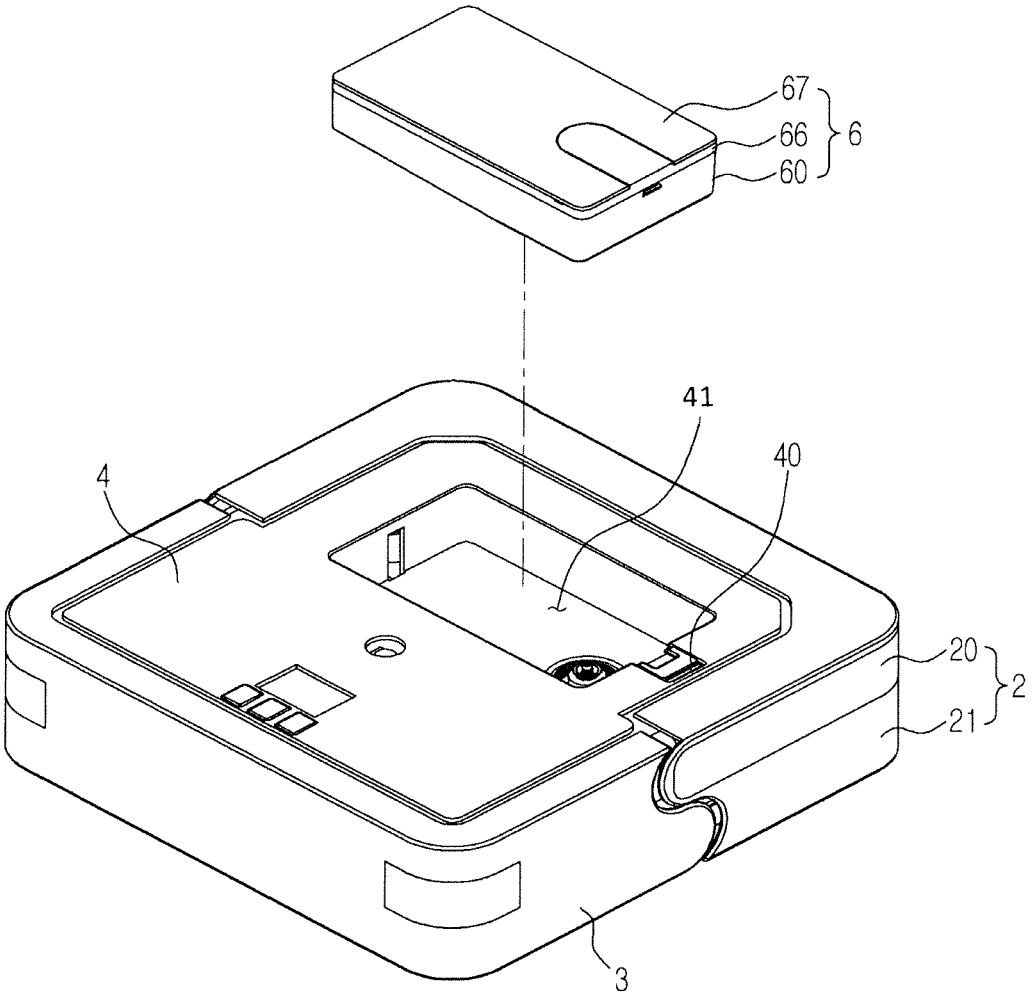
FIG. 15 illustrates a tank mounted on the robot cleaner according to one or more embodiments.
Figure 16:
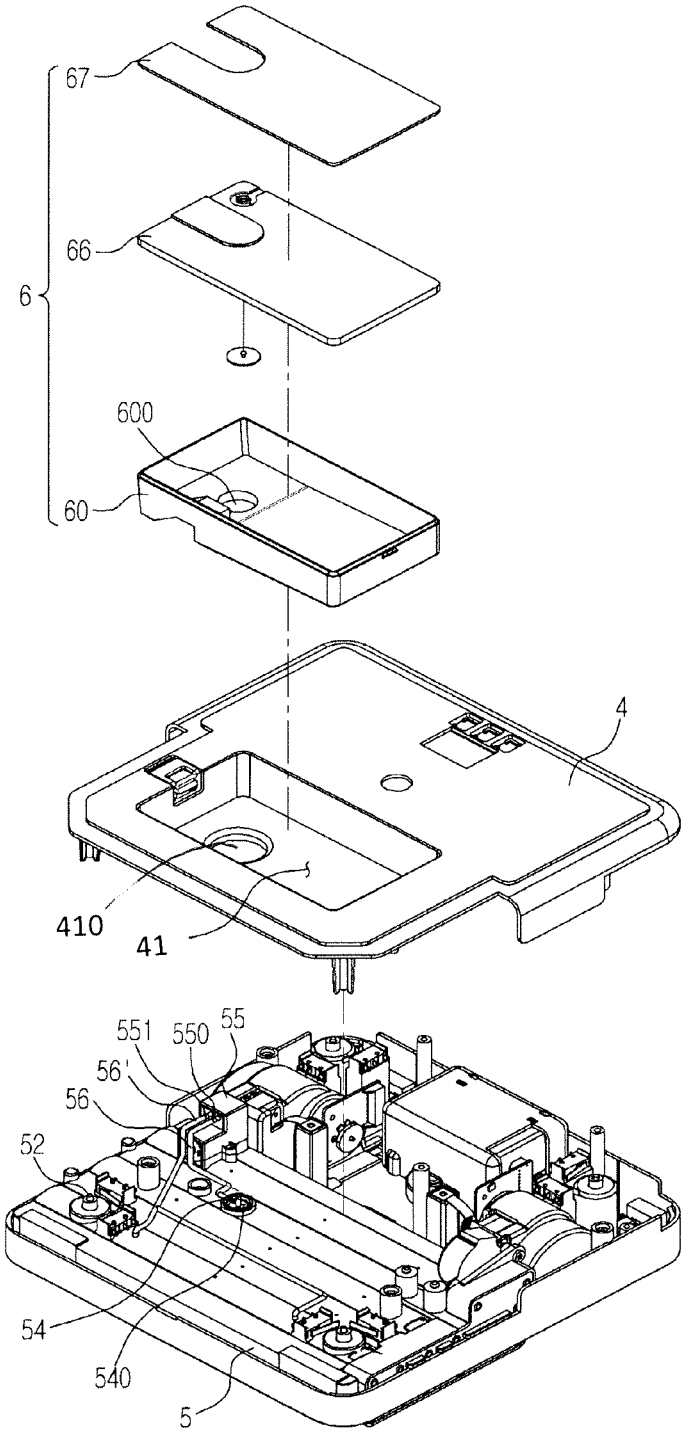
FIG. 16 is an exploded perspective view of the robot cleaner according to one or more embodiments.
Figure 17:
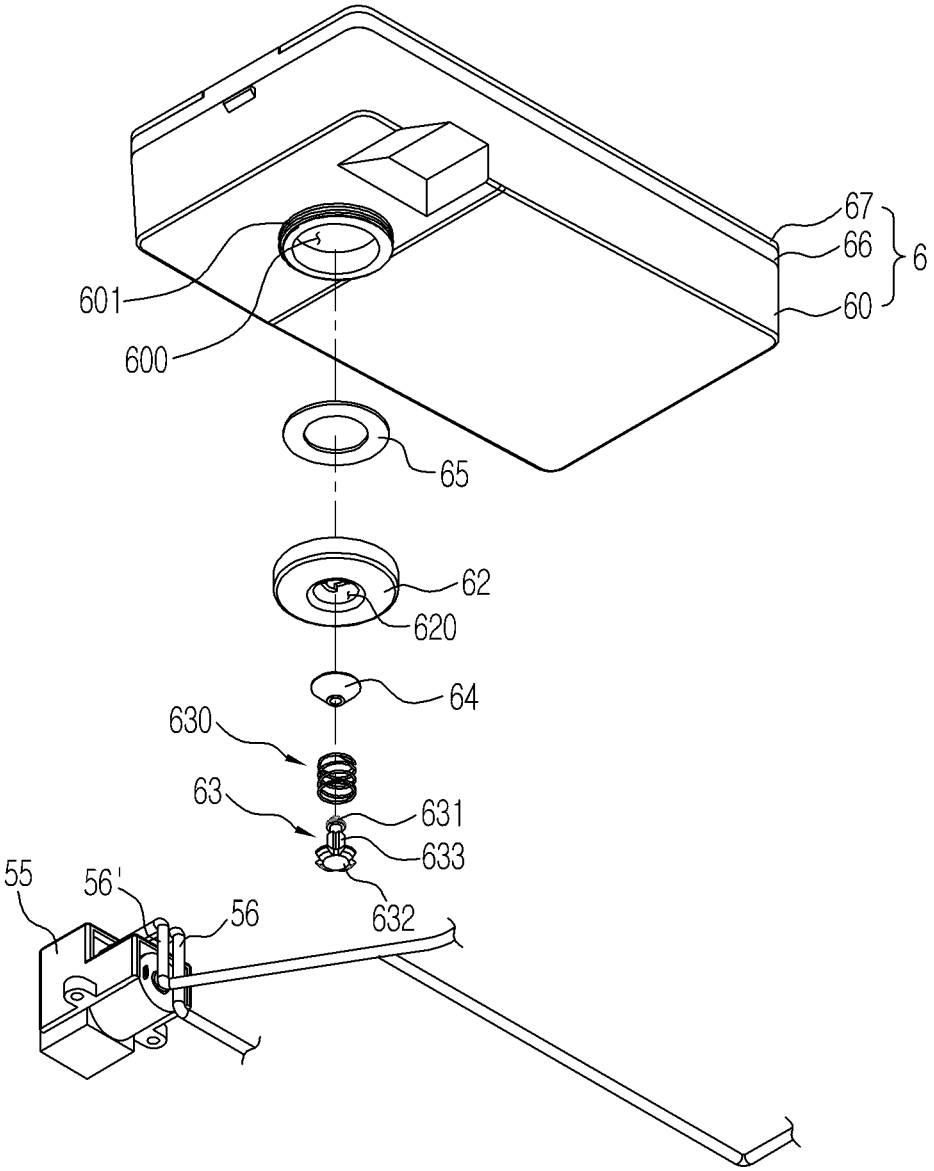
FIG. 17 is an exploded perspective view of a pump connector of the tank according to one or more embodiments.

FIG. 15 illustrates a tank mounted on the robot cleaner according to one or more embodiments, FIG. 16 is an exploded perspective view of the robot cleaner according to one or more embodiments, and FIG. 17 is an exploded perspective view of a pump connector of the tank according to one or more embodiments.

Referring to FIGS. 15 to 17, a tank receiver 41 may be formed on the cover 4 of the robot cleaner 1 according to one or more embodiments. A tank 6 may be received in the tank receiver 41 to supply fluid to the cleaning unit. A pump 55 may be connected to the tank 6, and a hose 56 running to the cleaning unit may be connected to the pump 55. Fluid contained in the tank 6 may be pumped by the pump 55, so that it may be supplied to the cleaning unit.

The tank 6 may be formed to be disposed at an upper part of the cleaning unit. Since the tank 6 may be disposed at an upper part of the cleaning unit, the cleaning unit may be pressurized toward a floor by the weight of the tank 6. As the force of pressurizing the floor by the cleaning unit is getting greater, the floor may be mopped by a greater force, so that a wet cleaning may be done.

The tank receiver 41 may be formed in a concave shape toward the frame 5 on the cover 4. The tank receiver 41 may be formed to correspond to the shape of the tank 6. A hole 410 through which the fluid in the tank 6 flows out may be formed on a bottom surface of the tank receiver 41.

The tank 6 may include a tank body 60, an intermediate member 66 and a tank cover 67. A hole 600 that is in communication with the hole 410 formed on the tank receiver 41 may be formed on the bottom surface of the tank body 60. A connector 601 may be formed to protrude on a bottom surface of the tank body 60 disposed around the hole 600. A thread may be formed on an external surface of the connector 601. A stopper 62 may be coupled to the connector 601. A thread corresponding to the thread formed on an external surface of the connector 601 may be formed in the stopper 62 to move along the external thread of the connector 601, so that the stopper 62 may be coupled to the connector 601.

A sealing member 65 may be interposed between the stopper 62 and the connector 601. The sealing member 65 may be formed of an elastic material such as rubber, for example, and may prevent leakage of fluid contained in the tank 6 to improve air-tightness.

A hole 620 may be formed on the center of the stopper 62. The cap 64 may be formed at an upper part of the hole 620. The cap 64 may be formed in a cylindrical shape whose upper diameter is greater than a lower diameter. The cap 64 may be formed smaller than the hole 600 formed at a bottom surface of the tank body 60. An upper diameter of the cap 64 may be formed greater than the diameter of the hole 620 formed on the stopper 62.

An opening and closing member 63 penetrating the hole 620 formed on the stopper 62 may be formed at a lower part of the stopper 62. A diameter of a head 632 of the opening and closing member 63 may be formed greater than a diameter of the hole 620 formed on the stopper 62. An elastic member 630 may be formed between the stopper 62 and the opening and closing member 63. A cap fixing part 631 may be formed at an end of the opening and closing member 63. A diameter of a cross-section of the cap fixing part 631 may be formed greater than a diameter of a cross-section of a body 633 of the opening and closing member 63. The cap fixing part 631 may be fixed to the cap 64. A diameter of a cross-section of the body 633 of the opening and closing member 63 may be formed smaller than a diameter of the hole 620 formed on the stopper 62.

For example, when the cap 64 is in the shape of a cylinder in which a hole whose upper part is in communication with a lower part, a diameter of the hole formed at a lower part of the cap 64 may be formed smaller than a diameter of the cap fixing part 631 such that the cap 64 is connected to the opening and closing member 63 to be fixed by passing the cap fixing part 631 through a lower hole of the cap 64. The cap 64 may selectively open and close the hole 600 formed at a bottom surface of the tank body 60 using the opening and closing member 63.

The pressure part 54 capable of pressurizing the opening and closing member 63 may be disposed at an upper surface of the frame 5. The pressure part 54 may be disposed at a position at which the pressure part 54 pressurizes the opening and closing member 63 formed on the tank 6. When fluid is received in the tank 6 and the tank 6 is received in the tank receiver 41, the pressure part 54 disposed on the frame 5 is disposed to pressurize the opening and closing member 63.

When the pressure part 54 pressurizes the opening and closing member 63, the cap 64 moves toward an upper part of the bottom surface of the tank body 60 together with the opening and closing member 63. When the cap 64 moves toward an upper part of the bottom surface of the tank body 60, the hole 600 formed on the bottom surface of the tank body 60 may be opened. Fluid received in the tank 6 may penetrate the hole 600 formed on the bottom surface of the tank body 60 and the hole 620 formed on the stopper 62 in communication with the hole 600 to flow toward the frame 5.

When fluid is contained in the tank 6 and the tank 6 is not received in the tank receiver 41, the fluid contained in the tank 6 enables the cap 64 to close the hole 600 formed on the bottom surface of the tank body 60. As a result, the leakage of the fluid received in the tank 6 to the outside of the tank 6 may be prevented.

A receiver 540 may be formed on the frame 5 to surround the pressure part 54. A predetermined amount of fluid flowing from the tank 6 may be received in the receiver 540. A hose connector 541 may be formed on a side of the receiver 540. The hose connector 541 may be in communication with the receiver 540, so that the fluid contained in the receiver 540 may move along the hose 56 connected to the hose connector 541.

The hose 56 connected to the hose connector 541 may be connected to the pump 55. The pump 55 may include an inlet part 550 and an outlet part 551. The hose 56 may connect the inlet part 550 to the hose connector 541. The hose 56 connected to the outlet part 551 may extend to the cleaning unit to supply fluid to the cleaning unit. When fluid is required to be supplied to the cleaning unit, the controller (not shown) may operate the pump 55 to supply fluid in the receiver 540 to the cleaning unit. Here, the fluid received in the tank 6 may be pumped by the pump 55 to be supplied to the cleaning unit through the receiver 540, the hose 56, the inlet part 550 and outlet part 551 of the pump 55, and a hose 56'.

Figure 18:
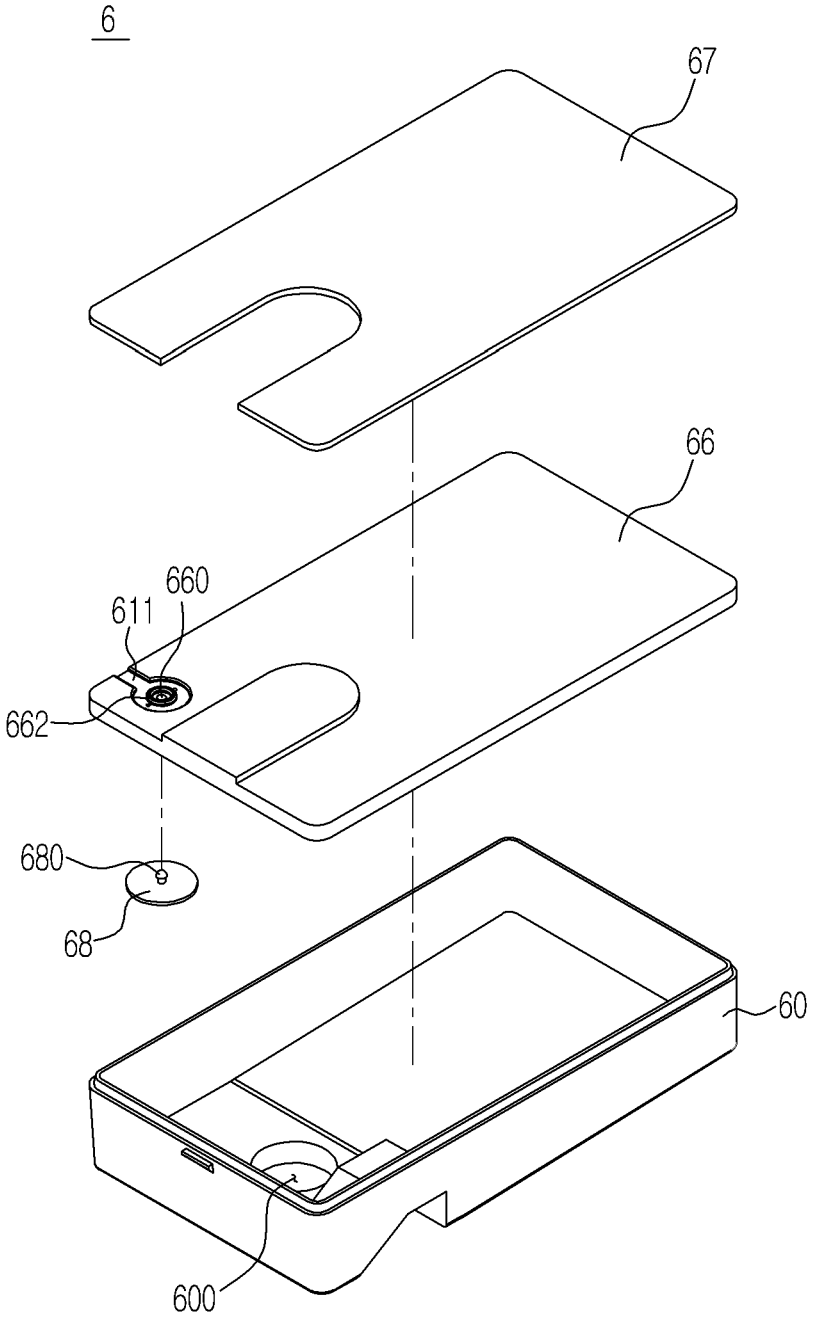
FIG. 18 is an exploded perspective view of a tank according to one or more embodiments.
Figure 19:
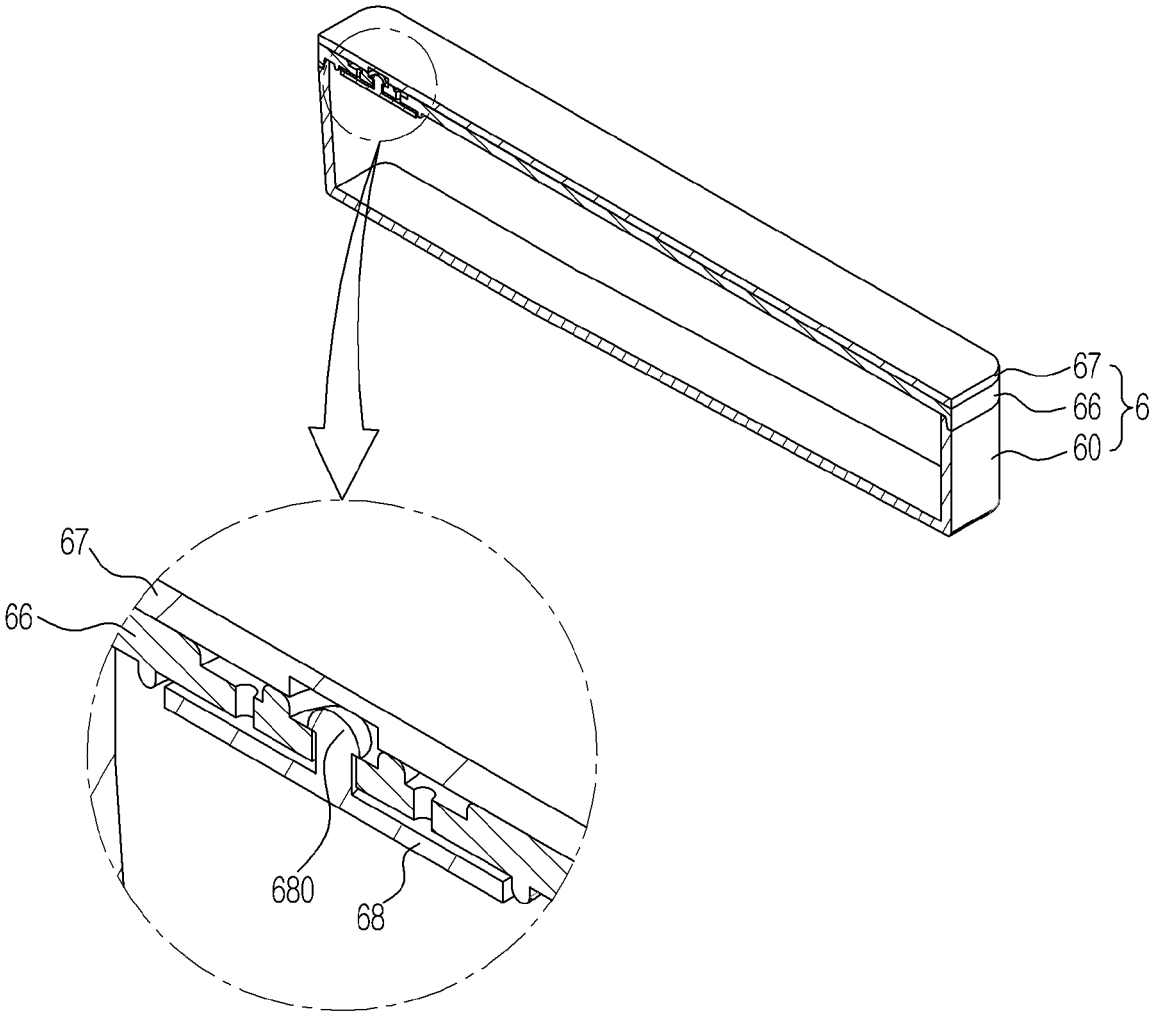
FIG. 19 is a cross-sectional view of the tank according to one or more embodiments.

FIG. 18 is an exploded perspective view of a tank according to one or more embodiments, and FIG. 19 is a cross-sectional view of the tank according to one or more embodiments.

Referring to FIGS. 18 and 19, the tank 6 according to one or more embodiments may include a tank body 60, an intermediate member 66 and a tank cover 67. A sealing member 68 may be formed between the intermediate member 66 and the cover 67. The sealing member 68 may be formed of an elastic material such as rubber, for example.

A sealing part 680 upwardly protruding may be formed on the sealing member 68. The sealing member 68 may be vertically movably disposed at a lower part of the intermediate member 66.

A hole 660 may be formed on the intermediate member 66, and a projection part 662 may be formed around the hole 660. A groove 611 may be formed around the projection part 662, so that the inside of the tank body 60 may be in communication with the outside through the groove 611 formed on the intermediate member 66. The sealing member 68 may be disposed at a lower part of the intermediate member 66, and the sealing part 680 may penetrate the hole 660. A tank cover 67 may be disposed at an upper part of the intermediate member 66.

When fluid is received in the tank 6 and the intermediate member 66 and the tank cover 67 cover the upper part of the tank body 60, the sealing member 68 may be downwardly pushed by the tank cover 67 such that the inside of the tank body 60 is in communication with the outside by the groove 611 formed on the intermediate member 66. When the tank 6 is received in the tank receiver 41, the inside of the tank body 60 may be in communication with the outside to enable air from the outside to flow into the tank 6, so that the air from the outside may replace fluid pumped and discharged from inside the tank 6 when pumped by the pump 55. As a result, the pump 55 facilitates the pumping of the fluid in the tank 6.

When the tank cover 67 of the tank 6 turns downward with fluid contained in the tank 6 and the tank body 60 is turned bottom side up, the sealing member 68 may be pressurized by the fluid contained in the tank 6 to close the hole 660. Here, the inside and outside of the tank 6 may be in water tight state in which a fluid flow path is closed, and the fluid in the tank 6 may not leak.

Figure 20:
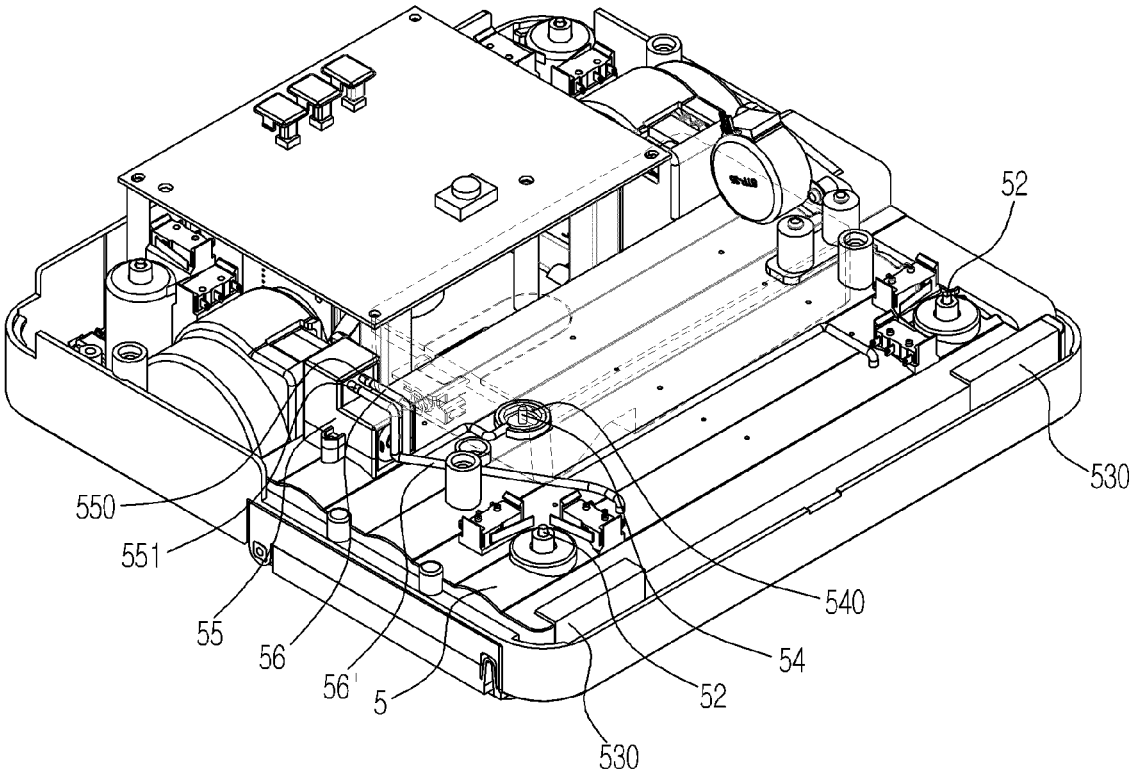
FIG. 20 illustrates a robot cleaner from which a cover is removed according to one or more embodiments.
Figure 21:
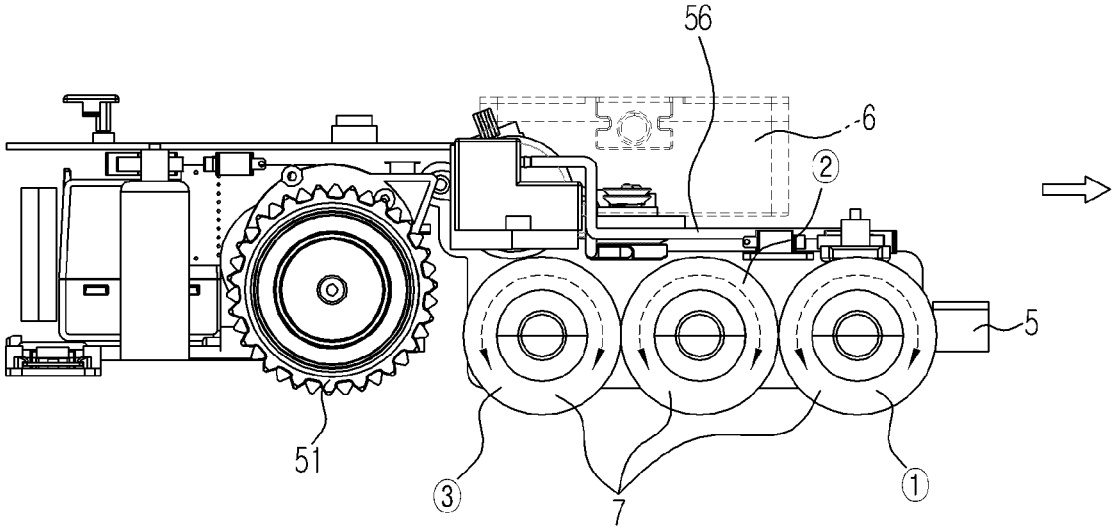
FIG. 21 is a side view of a robot cleaner according to one or more embodiments such as the robot cleaner of FIG. 20.

FIG. 20 illustrates a robot cleaner from which a cover is removed according to one or more embodiments, and FIG. 21 is a side view of a robot cleaner according to one or more embodiments such as the robot cleaner in FIG. 20.

Referring to FIGS. 20 and 21, fluid such as water, for example, received in the tank 6 of the robot cleaner 1 according to one or more embodiments may be supplied to the cleaning unit by the pump 55.

The cap 64 formed on a bottom surface of the tank 6 may be pressurized by the pressure part 54 formed on the frame 5, and the fluid in the tank 6 may be received in the receiver 540 formed around the pressure part 54. The hose connector 541 formed on the receiver 540 may be connected to the hose 56 connected to the inlet part 550 of the pump 55. The hose 56' connected to the outlet part 551 of the pump 55 may extend to the cleaning unit. For example, a hole may be formed on the frame 5, and the hose 56' may be formed to be in communication with the hole or may extend to an upper part of the cleaning unit through the hole. As a result, fluid flowing along the hose 56' may be supplied to the cleaning unit.

When it is necessary to supply fluid to the cleaning unit, the controller (not shown) may operate the pump 55 to supply the fluid in the receiver 540 to the cleaning unit. Here, the fluid received in the tank 6 may be pumped by the pump 55 to be supplied to the cleaning unit via the receiver 540, the hose 56, an inlet part 550 of the pump 55, an outlet part 551 of the pump, and the hose 56'.

Here, the hose 56' may be divided to spray at several positions of the cleaning unit. For example, when three (①, ②, and ③) roll pad assemblies 7 are formed, the hose 56' may be divided into the same number as the roll pad assemblies 7 to supply fluid to each of the roll pad assemblies 7 or may be formed to supply fluid only to a roll pad assembly ① on the front line.

When fluid is supplied to each of the three roll pad assemblies 7, the three roll pad assemblies 7 may do a wet cleaning, and when fluid is supplied only to the roll pad assembly ① on the front line, the one roll pad assembly ① may do a wet cleaning with a wet roll pad and the other two roll pad assemblies may wipe the floor with a dry cloth. In this case, moisture remaining after the wet cleaning may be removed.

As illustrated in FIG. 20, the hose 56' may be divided such that fluid is supplied from two or more locations of the roll pad assembly 7. The hose 56' may be divided to supply fluid from several positions of the cleaning unit, and may be controlled to supply fluid only to a necessary part by the controller (not shown).

Figure 22:
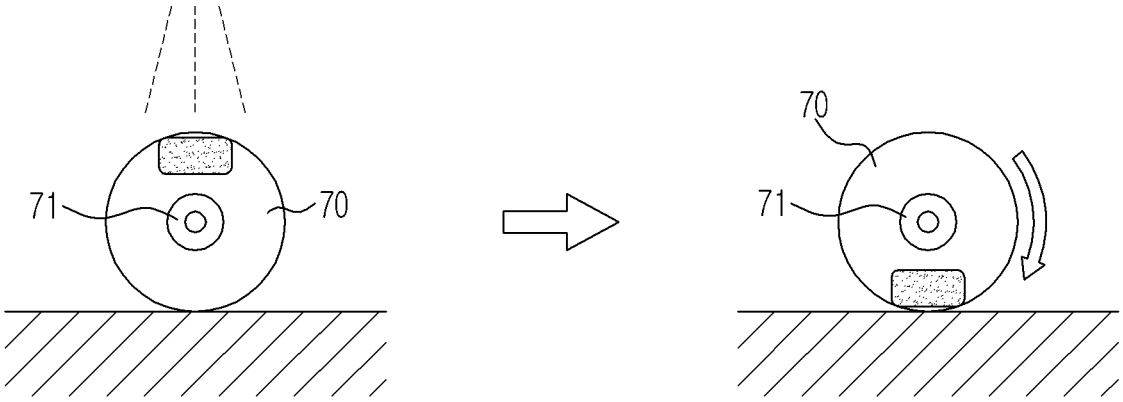
FIG. 22 illustrates fluid sprayed to a roll pad according to one or more embodiments.
Figure 23:
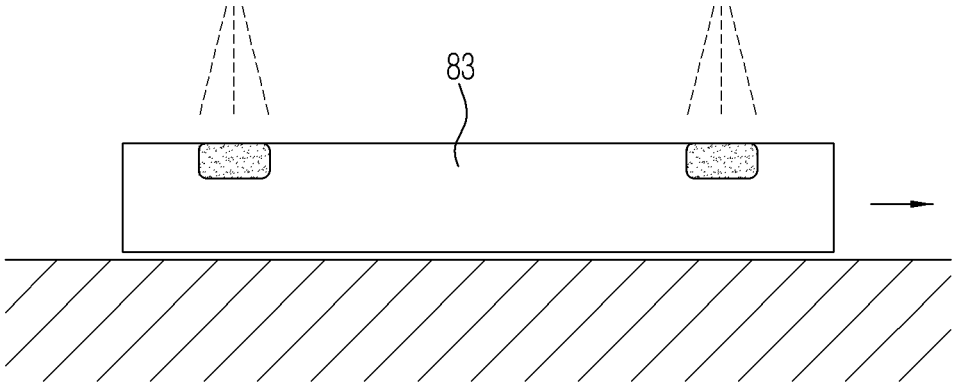
FIGS. 23 and 24 illustrate fluid sprayed to a pad according to one or more embodiments.
Figure 24:
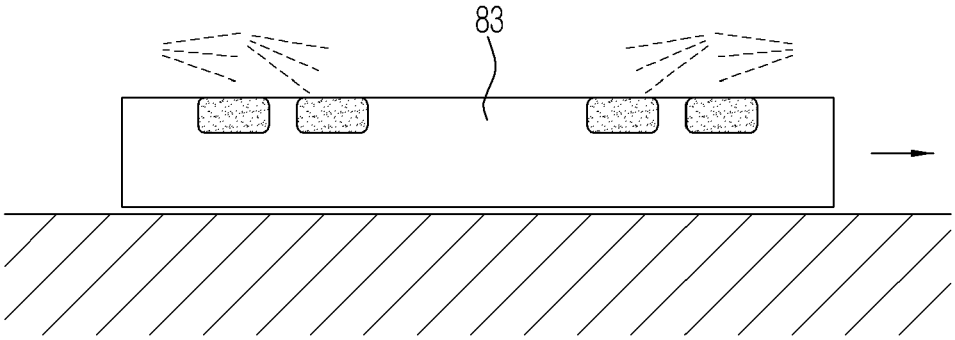

FIG. 22 illustrates fluid sprayed to a roll pad according to one or more embodiments, and FIGS. 23 and 24 illustrate fluid sprayed to the other pads according to one or more embodiments.

Referring to FIG. 22, it is illustrated that fluid may be supplied to the roll pad assembly 7 according to one or more embodiments. A surface of the roll pad on the roll pad assembly 7 according to one or more embodiments may be supplied with fluid through the hose 56', and the roll pad 70 may rotate in a clockwise or counterclockwise direction to do a wet cleaning. When fluid is supplied to the surface of the roll pad 70, the roll pad 70 may rotate, so that the surface to which fluid is supplied may be used for cleaning a floor.

Referring to FIG. 23, fluid may be supplied from both ends of a pad assembly 8 according to one or more embodiments. Since fluid may be supplied to an upper surface of the pad assembly 8 and a bottom surface of the pad 83 mounted on the pad assembly 8 may clean the floor, it may take a predetermined amount of time to supply fluid to the bottom surface of the pad 83, but the structure of the hose 56' supplying fluid to the pad assembly 8 may be implemented.

Referring to FIG. 24, fluid may be diagonally supplied from both ends of the pad assembly 8 according to one or more embodiments. In this case, fluid may be uniformly sprayed to the pad 83.

Figure 25:
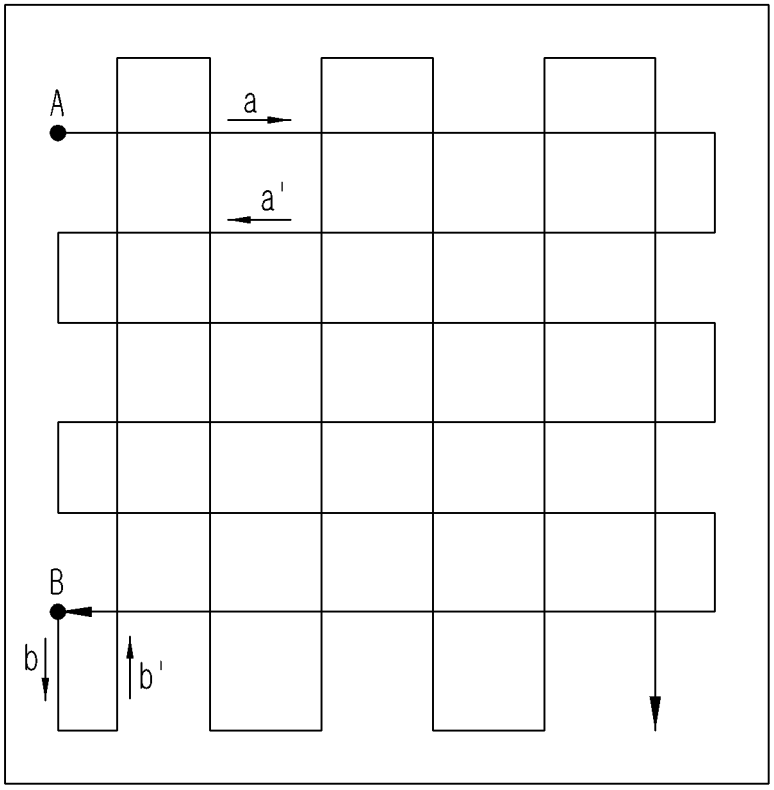
FIGS. 25 and 26 illustrate a driving path of a robot cleaner according to one or more embodiments.
Figure 26:
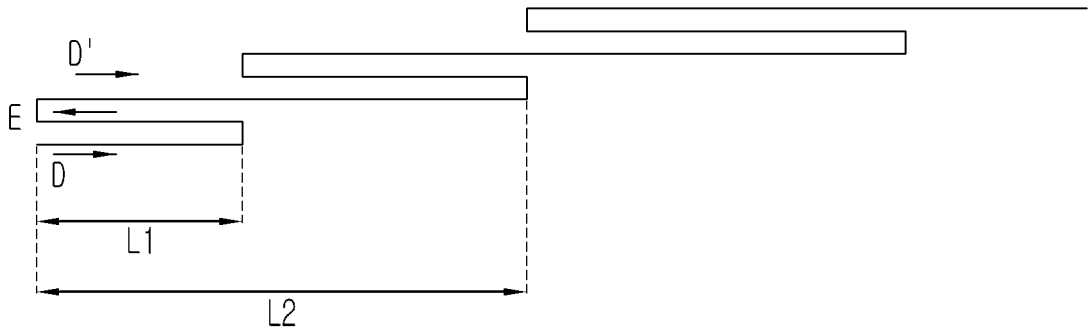

FIGS. 25 and 26 illustrate a driving path of a robot cleaner according to one or more embodiments.

Referring to FIGS. 25 and 26, the driving part may cause the wheel to rotate, so that the robot cleaner 1 according to one or more embodiments may navigate along a path such as the path illustrated in FIG. 25. The robot cleaner 1 beginning to navigate from a point A may be controlled to advance forward in a direction of a, and then to laterally move by a predetermined distance, so that it repeats to advance forward in the direction of a'.

Upon arrival at a point B, the robot cleaner 1 may be controlled to advance forward in a direction of b, and then laterally to laterally move by a predetermined distance, so that it repeats to advance forward in the direction of b'.

As previously stated, when the robot cleaner 1 drives to clean the floor, the same portion of floor may be cleaned more than once.

As illustrated in FIG. 26, the robot cleaner 1 may repeat to go forward or backward within the predetermined same area by rotating the wheel 51 in a clockwise or counterclockwise direction. For example, when the robot cleaner 1 advances forward by a predetermined distance L1 in a direction of D, it may go backward in a direction of E by the predetermined distance L1, and may move by a distance L2 in the direction of D (D') again. L2 may be twice as long as L1. The robot cleaner 1 moving as long as L2 may repeat to move forward or backward as above, so that the floor is cleaned. As illustrated in FIG. 26, the operation may enable the same floor to be cleaned three times.

When the driving operation illustrated in FIG. 26 is repeated and the driving along the path illustrated in FIG. 25 is performed, the same floor may be cleaned six times.

The number of repeated forward and backward operations illustrated in FIG. 26 is not limited to the above description, and when a considerably contaminated floor is cleaned, the robot cleaner may stop at the same place and rotate the roll pad assembly to wipe the floor or further repeat forward or backward operations. Also, the driving path of the robot cleaner 1 is not limited to that illustrated in FIG. 25. The driving path of the robot cleaner 1 or the number of repeated driving operations may be adjusted according to a degree of contamination of a floor or a user's selection.

In a robot cleaner according to one or more embodiments, a contaminated pad may be replaced with a new pad, and friction force between the pad and a floor may be sufficiently ensured, so that the cleaning of the floor can be better, so that improved effects brought on by a wet cleaning using a pad can be obtained.

While aspects of the present invention have been particularly shown and described with reference to differing embodiments thereof, it should be understood that these embodiments should be considered in a descriptive sense only and not for purposes of limitation. Descriptions of features or aspects within each embodiment should typically be considered as available for other similar features or aspects in the remaining embodiments. Suitable results may equally be achieved if the described techniques are performed in a different order and/or if components in a described system, architecture, device, or circuit are combined in a different manner and/or replaced or supplemented by other components or their equivalents.

Thus, although a few embodiments have been shown and described, with additional embodiments being equally available, it would be appreciated by those skilled in the art that changes may be made in these embodiments without departing from the principles and spirit of the invention, the scope of which is defined in the claims and their equivalents.

What is claimed is:

1. A robot cleaner, comprising:

a frame including a wheel for driving;

a cleaning unit disposed at a lower part of the frame to clean a bottom surface, and disposed in front of the wheel;

a tank disposed at an upper part of the wheel, and configured to supply fluid to the cleaning unit;

a pump configured to pump the fluid contained in the tank such that the fluid contained in the tank is supplied to the cleaning unit;

a hose configured to extend to the pump and the upper part of the cleaning unit, and through which the fluid pumped by the pump flows; and a bumper formed on a side of the frame, wherein the cleaning unit includes:

a first frame;

a second frame hinge-coupled to the first frame; and a pad fixed between the first frame and the second frame to clean the surface.

2. The robot cleaner according to claim 1, wherein the frame comprises a cleaning unit receiver at its lower part, and the cleaning unit is detachably disposed in the cleaning unit receiver.

3. The robot cleaner according to claim 2, wherein the cleaning unit receiver comprises a holder including a projection insertion part.

4. The robot cleaner according to claim 3, wherein the cleaning unit comprises a fixing projection inserted into the projection insertion part.

5. The robot cleaner according to claim 3, wherein the holder comprising:

a first holder disposed on a side of the cleaning unit receiver; and a second holder disposed on the other side of the cleaning unit receiver, wherein the second holder is disposed to be opened and closed and comprises a fixing holder and a moving holder hinge-coupled to one side of the fixing holder.

6. The robot cleaner according to claim 1, wherein the first frame is disposed to be hook-coupled to the second frame after the pad is inserted between the first frame and the second frame.

7. The robot cleaner according to claim 1, wherein the pad is a disposable pad.

8. A robot cleaner, comprising:

a frame including a driving part;

a wheel mounted on the frame, and configured to rotate by receiving driving force from the driving part;

a cleaning unit disposed in front of the wheel, and detachably disposed at a lower part of the frame;

a tank disposed at an upper part of the cleaning unit;

a pump configured to pump fluid contained in the tank; and a hose connected to the pump to supply fluid to the cleaning unit, wherein the cleaning unit includes:

a first frame;

a second frame hinge-coupled to the first frame; and a pad fixed between the first frame and the second frame to clean the surface.

9. The robot cleaner according to claim 8, wherein the frame comprises a cleaning unit receiver, and the cleaning unit receiver comprises a holder on which the cleaning unit is detachably mounted.

10. The robot cleaner according to claim 9, wherein the cleaning unit comprises a fixing projection formed thereon, and the holder comprises a projection insertion part into which the fixing projection is inserted.

11. The robot cleaner according to claim 10, wherein the projection insertion part is supported by an elastic member to be applied with an elastic force toward the cleaning unit receiver.

12. The robot cleaner according to claim 8, wherein the wheel repeats rotation in a clockwise or counterclockwise direction, and drives to repeat forward or backward movement at a predetermined interval.

13. The robot cleaner according to claim 12, wherein the robot cleaner advances in a first direction, moves laterally by a predetermined distance and moves in a second direction, the second direction being opposite and parallel to the first direction.

14. The robot cleaner according to claim 13, wherein the robot cleaner moves forward by a first distance, moves backward by a second distance and moves forward by a third distance, the third distance being greater than the first distance.

15. The robot cleaner according to claim 8, wherein the first frame is disposed to be hook-coupled to the second frame after the pad is inserted between the first frame and the second frame.

16. A robot cleaner, comprising:

a frame;

a cleaning unit detachably disposed at a lower part of the frame;

a tank disposed at an upper part of the cleaning unit;

a pump configured to pump fluid contained in the tank; and a hose connected to the pump to supply fluid to the cleaning unit, wherein the cleaning unit includes:

a first frame;

a second frame hinge-coupled to the first frame; and a pad fixed between the first frame and the second frame to clean the surface.

17. The robot cleaner according to claim 16, wherein the frame comprises a cleaning unit receiver, and the cleaning unit receiver comprises a holder on which the cleaning unit is detachably mounted.

18. The robot cleaner according to claim 17, wherein the cleaning unit comprises a fixing projection formed thereon, and the holder comprises a projection insertion part into which the fixing projection is inserted.

19. The robot cleaner according to claim 16, wherein the first frame is disposed to be hook-coupled to the second frame after the pad is inserted between the first frame and the second frame.

* * * * *